US011662128B2

(12) United States Patent
Deaville

(10) Patent No.: US 11,662,128 B2
(45) Date of Patent: May 30, 2023

(54) REFRIGERANT LEAK DETECTOR FOR A VENDING MACHINE

(71) Applicant: Crane Payment Innovations, Inc., Malvern, PA (US)

(72) Inventor: David Charles Deaville, West Chester, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 94 days.

(21) Appl. No.: 17/058,592

(22) PCT Filed: Jul. 9, 2019

(86) PCT No.: PCT/US2019/041077
§ 371 (c)(1),
(2) Date: Nov. 24, 2020

(87) PCT Pub. No.: WO2020/014279
PCT Pub. Date: Jan. 16, 2020

(65) Prior Publication Data

US 2021/0215413 A1 Jul. 15, 2021

Related U.S. Application Data

(60) Provisional application No. 62/695,717, filed on Jul. 9, 2018.

(51) Int. Cl.
*F25B 49/02* (2006.01)
*A47F 3/02* (2006.01)
(Continued)

(52) U.S. Cl.
CPC ..... *F25B 49/02* (2013.01); *A47F 3/02* (2013.01); *A47F 3/0478* (2013.01); *A47F 10/02* (2013.01);
(Continued)

(58) Field of Classification Search
CPC ..... F25B 2400/12; F25B 2500/222; A47F 10/02; A47F 3/02; A47F 3/0478
See application file for complete search history.

(56) References Cited

U.S. PATENT DOCUMENTS 6,772,598 B1 8/2004 Rinehart
2004/0142685 A1* 7/2004 Glasser ..... G07F 9/002 455/420
(Continued)

FOREIGN PATENT DOCUMENTS

JP 2002-092714 A 3/2002
JP 2003178361 A 6/2003
(Continued)

OTHER PUBLICATIONS

Supplementary European Search Report dated Feb. 28, 2022, in connection with European Application No. 19833237.1, 4 pages.
(Continued)

*Primary Examiner* — Henry T Crenshaw

(57) ABSTRACT

One or more example embodiments provide a vending machine (105) that detects refrigerant leaks. The vending machine includes a main cabinet (605), a sensor circuit (615), and control equipment (830). The sensor circuit is configured to detect a refrigerant leaked in the main cabinet. The control equipment is configured to operate a component (620) of the refrigerated vending machine based on the detected refrigerant.

15 Claims, 15 Drawing Sheets

(51) Int. Cl.
*A47F 3/04* (2006.01)
*A47F 10/02* (2006.01)

(52) U.S. Cl.
CPC ..... *F25B 2400/12* (2013.01); *F25B 2500/222* (2013.01)

(56) References Cited

U.S. PATENT DOCUMENTS

2005/0056031 A1 3/2005 Jeong
2005/0103029 A1* 5/2005 Kawahara ..... F25D 29/008 62/126
2010/0107668 A1* 5/2010 Voorhis ..... F25B 49/02 62/115
2012/0292006 A1* 11/2012 Yamashita ..... F24F 3/06 165/200
2014/0297487 A1* 10/2014 Bashkin ..... A47B 96/02 705/28
2014/0341253 A1 11/2014 Kobayashi et al.
2016/0019769 A1* 1/2016 Mumey ..... G08B 21/14 340/632
2017/0059185 A1* 3/2017 Suzuki ..... F25B 47/025
2017/0317494 A1 11/2017 Chapel et al.
2017/0328620 A1 11/2017 Ikawa et al.

FOREIGN PATENT DOCUMENTS

JP 2004012127 A 1/2004
JP 2004069295 A 3/2004
JP 2009-079818 A 4/2009
JP 2009 093467 * 4/2009
JP 2009258951 A 11/2009
JP 5304166 B2 10/2013
WO 2004016999 A1 2/2004

OTHER PUBLICATIONS

Communication pursuant to Article 94(3) EPC dated Mar. 14, 2022, in connection with European Application No. 19833237.1, 6 pages.
International Search Report and Written Opinion of the International Searching Authority in connection with International Application No. PCT/US2019/041077 dated Sep. 27, 2019, 11 pages.

* cited by examiner

REFRIGERANT LEAK DETECTOR FOR A VENDING MACHINE

CROSS-REFERENCE TO RELATED APPLICATIONS

This application is a 371 National Stage of International Application No. PCT/US2019/041077, filed Jul. 9, 2019, which claims the benefit of Provisional Application 62/695,717, filed Jul. 9, 2018, the disclosures of which are herein incorporated by reference in their entirety.

TECHNICAL FIELD

This disclosure is generally directed to vending machines. More specifically, this disclosure is directed to a refrigerant leak detector for a vending machine.

BACKGROUND

Vending machines include many complex mechanisms. Vending machines are typically refrigerated in order to improve the shelf life of the product and provide an enhanced consumer experience by delivering a chilled product. Refrigerants that need to be contained within the system are commonly used to enhance the cooling ability of the vending machines.

SUMMARY

This disclosure provides refrigerant leak detection for a vending machine.

A vending machine that detects refrigerant leaks is provided. The vending machine includes a main cabinet, a refrigerated compartment, a sensor circuit, and control equipment. The refrigerated compartment is located in the main cabinet and configured to store chilled goods. The sensor circuit is configured to detect a refrigerant leaked in the refrigerated compartment. The control equipment is configured to operate a component of the refrigerated vending machine based on the detected refrigerant.

A vending machine that detects refrigerant leaks is provided. The vending machine includes a main cabinet, a refrigerated compartment, a first sensor circuit, a second sensor circuit, and control equipment. The refrigerated compartment is located in the main cabinet and configured to store chilled goods. The first sensor circuit is configured to detect a refrigerant leaked in the refrigerated compartment. The second sensor circuit is configured to detect a refrigerant leaked in the main cabinet and outside of the refrigerated compartment. The control equipment is configured to disable power to the refrigerated vending machine based on the detected refrigerant.

A vending machine that detects refrigerant leaks is provided. The vending machine includes a main cabinet, a refrigerated compartment, a first sensor circuit, a second sensor circuit, a battery, and control equipment. The refrigerated compartment is located in the main cabinet and configured to store chilled goods. The first sensor circuit is configured to detect a refrigerant leaked in the refrigerated cabinet. The second sensor circuit is configured to detect a refrigerant leaked in the main cabinet and outside of the refrigerated compartment. The battery is configured to provide power to the first sensor circuit, the second sensor circuit and the control equipment. The control equipment is configured to disable external power to the refrigerated vending machine based on the detected refrigerant during startup of the refrigerated vending machine.

Other technical features may be readily apparent to one skilled in the art from the following figures, descriptions, and claims.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure, reference is now made to the following description, taken in conjunction with the accompanying drawings, in which.

Figure 1:
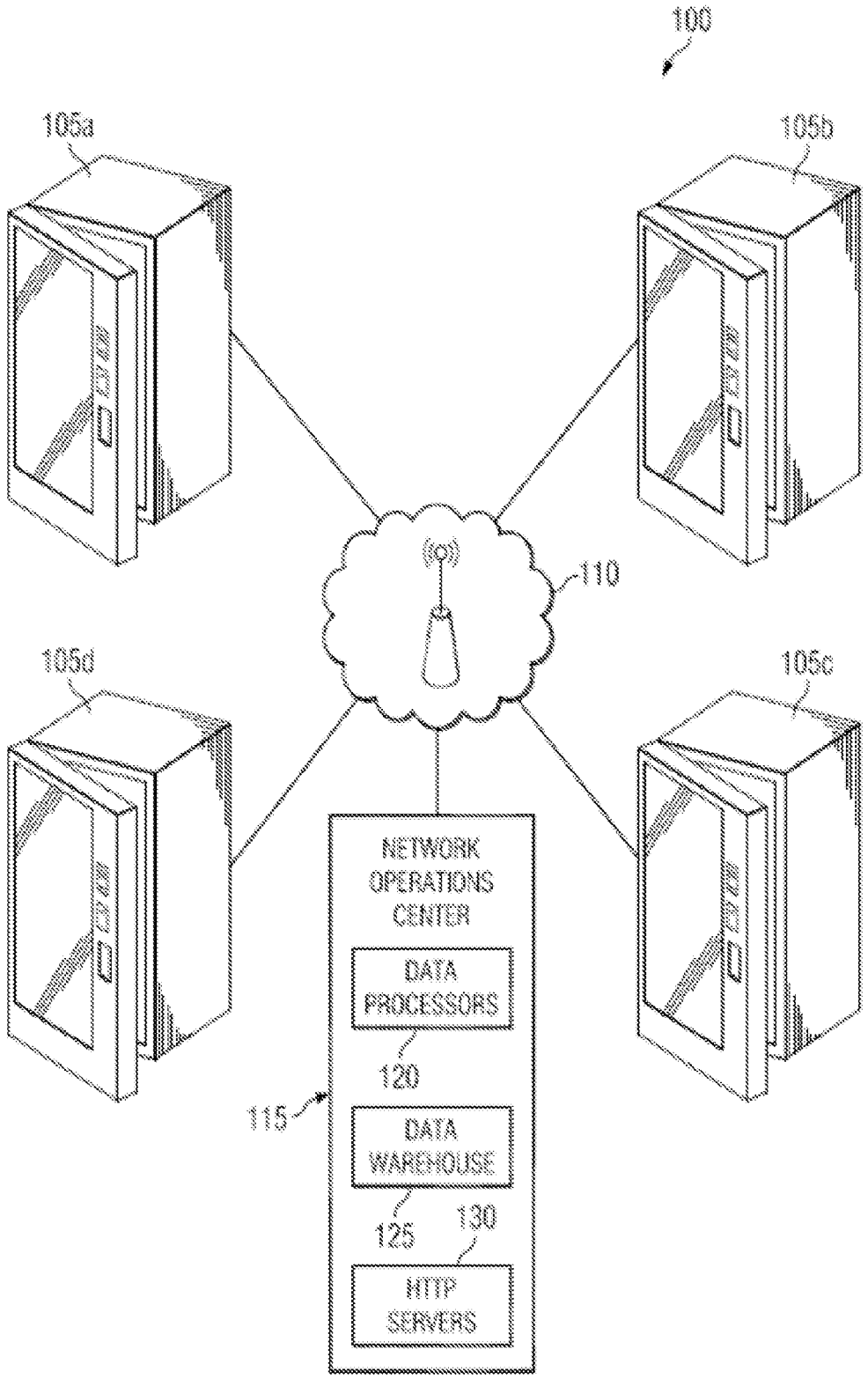
FIG. 1 illustrates an exemplary vending network including a vending machine that implements refrigerant leak detection according to embodiments of the present disclosure.

Before undertaking the DETAILED DESCRIPTION below, it may be advantageous to set forth definitions of certain words and phrases used throughout this patent document: the terms "include" and "comprise," as well as derivatives thereof, mean inclusion without limitation: the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. The phrase "at least one of," when used with a list of items, means that different combinations of one or more of the listed items may be used, and only one item in the list may be needed. Definitions for certain words and phrases are provided throughout this patent document, those of ordinary skill in the art should understand that in many, if not most instances, such definitions apply to prior, as well as future uses of such defined words and phrases.

DETAILED DESCRIPTION

FIGS. 1 through 10B, discussed below, and the various embodiments used to describe the principles of the present invention in this patent document are by way of illustration only and should not be construed in any way to limit the scope of the disclosure. Those skilled in the art will understand that the principles of this disclosure may be implemented in any suitably arranged device or system.

This application provides methods for detecting and taking responsive action to a release (leak) of a VOC (volatile organic compound) gas—hydrocarbon. Embodiments of this disclosure include providing the opportunity to take responsive action to mitigate hazards presented by flammable gases and ignition sources. Requirements for this application include analog or digital circuitry and VOC sensors to detect the presence and/or amount of a VOC in the environment in which it is placed.

Vending machines are typically refrigerated in order to improve the shelf life of the product and provide an enhanced consumer experience by delivering a chilled product. The design of refrigeration systems for these machines typically uses technology common to other industries such as domestic and commercial food refrigerators. The prevailing refrigerant in current applications is 1,1,1,2-Tetrafluoroethane commercially marketed under various names such as Freon, R-134a, etc. This gas in turn replaced dichlorodifluoromethane (R-12) whose production was banned in developed countries in 1996 under the Montreal Protocol because of the observed damage to the stratospheric ozone layer. While R-134a has many desirable properties including low ozone depletion, toxicity and flammability, it does have a significant greenhouse gas effect. In fact, the GWP (global warming potential) of R-134a is 1,430 (i.e., one pound of R-134a has the same GWP of 1,430 pounds of CO2). As a result, the refrigeration industry is changing over to alternative refrigerants. Prominent among the alternative refrigerants are hydrocarbon-based alternatives. Propane, commercially sold as R290 refrigerant, is one of several hydrocarbon alternatives that offer 0 ozone depletion potential (ODP) and low GWP. Although these naturally occurring gases have many positive attributes as refrigerants, they also possess significant concerns with flammability that must be addressed in design and use. In the case of R290, it forms an explosive mixture with air in concentrations between 14% and 65%. Since at this point the refrigeration industry seems to be committed to the use of R290, this application addresses the need to provide additional means to maximize safety from the ignition hazards introduced by this refrigerant.

FIG. 1 illustrates a vending network 100 including a vending machine that implements refrigerant leak detection according to embodiments of the present disclosure. Although certain details will be provided with reference to the components of a vending network 100 of FIG. 1, it should be understood that other embodiments may include more, less, or different components. The vending network 100 includes a plurality of vending machines 105*a*, 105*b*. 105*c*, and 105*d*. Each of the vending machines 105*a* through 105*d* is coupled to a data communications system 110. In certain embodiments, the vending network 100 includes one vending machine 105 coupled to the data communication system 110. That is, one or more of the vending machines 105 are not directly coupled to the data communications system 110. The data communications system 110 facilitates data communications between at least one vending machine 105 and a central facility, such as a network operations center 115.

The data communications system 110 can be implemented in a known manner, such as by utilizing any one or combination of: an Internet Protocol (IP), a HyperText Transmission Protocol (HTTP) communication over the Internet (e.g., the world wide web), or secured by authentication and encryption processes to create a Virtual Private Network (VPN). One or more of the vending machines 105*a* through 105*d* communicate with the data communications system 110 using a wireless communication, wired communication, or a combination of wired and wireless communications. The communications between the data communications system 110 and the vending machines 105*a* through 105*d* can utilize known IP or HTTP access and communication methods. As described herein, one or more of the vending machines 105*a* through 105*d* can communicate product information of products stored in one or more of the vending machines 105*a* through 105*d* or a remaining quantity of each product stored in one or more of the vending machines 105*a* through 105*d* with one or more of the other vending machines 105*a* through 105*d* through the data communications system 110.

The network operations center 115 includes a number of components such as data processors 120, a data warehouse 125, and Hypertext Transfer Protocol (HTFP) servers 130. Accordingly, using the communications provided by the data communications system 110, the vending machines 105*a* through 105*d* connect to the network operations center 115 and the components contained within the network operations center 115. In certain embodiments, the data processors 120 are connected to the data warehouse 125 and the HTTP servers 130. The data processors 120 send and receive data to and from the data warehouse 125 and the HTTP servers 130. The data processors 120 perform calculations using the data received from the data warehouse 125, the HTTP servers 130, or both. In certain embodiments, one or more of the vending machines 105*a* through 105*d* send and receive data to the data processors 120. In certain embodiments, one or more of the vending machines 105*a* through 105*d* send and receive data to the data warehouse 125. The data warehouse 125 is capable of storing data in databases, such as rich structured query language ("SQL") databases. For example, the data warehouse 125 is capable of storing passive or interactive advertisements for display, polls for display, selection menus for display, payment menus for display, product purchase display queues, transaction complete display queues, one or more refrigerant leak detection rules, or one or more refrigerant leak detection inputs, as described herein, for transmission to one or more of the vending machines 105*a* through 105*d*. Through a connection with the HTTP servers 130, one or more of the vending machines 105*a* through 105*d* connects to the Internet (e.g., the world wide web) and accesses websites and retrieves data therefrom. For example, one or more of the vending machines 105*a* through 105*d* may connect to the internet through a connection with an HTTP server 130 to receive one or more refrigerant leak detection inputs, as described herein.

Figure 2:
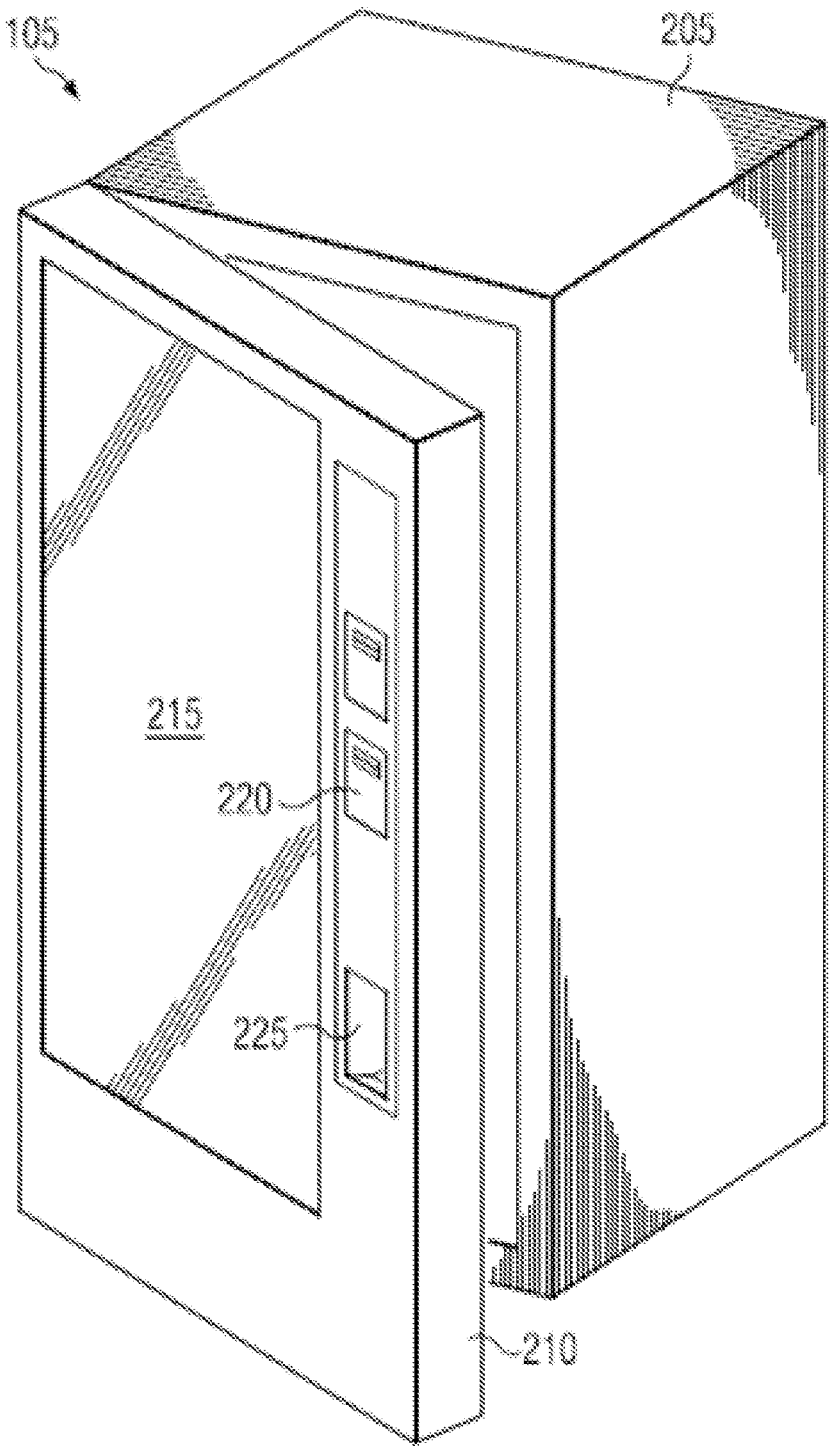
FIG. 2 illustrates an exemplary vending machine that implements refrigerant leak detection according to embodiments of the present disclosure.

FIG. 2 illustrates an exemplary vending machine that implements refrigerant leak detection according to embodiments of the present disclosure. Although certain details will be provided with reference to the components of the vending machine 105 of FIG. 2, it should be understood that other embodiments may include more, less, or different components. It should also be understood that although vending machine 105 is illustrated here by example, vending machine 105 represents any one of the vending machines 105*a* through 105*d*.

The vending machine 105 is configured to store a plurality of products for sale via a vending operation. The vending machine 105 includes a cabinet 205 and a service door 210. The cabinet 205 and the service door 210 form an enclosure, in which the plurality of products is stored. For some vending machines, the service door 210 is pivotally mounted along a front edge of the cabinet 205, and spans the entire front face of the vending machine 105. For other vending machines, the service door 210 extends only across a portion of the front of the vending machine 105, and is formed in two portions of equal or unequal sizes. The two portions of such service doors can be mounted to swing open in opposite directions.

The vending machine 105 includes a user interface 215. The user interface 215 is located on a front face of the vending machine 105, such as on a front portion of the cabinet 205 or on the service door 210. The user interface 215 includes a display configured to render information in video format, graphical format, textual format, or a combination thereof. Preferably, the display is a touch display screen, such as a liquid crystal display ("LCD") screen with user touch detection. For example, the display can display a passive or an interactive advertisement, a poll, a product selection menu, a payment selection menu, a product selection display queue, a transaction complete display queue, or an indication of refrigerant leak detection, as described herein. In certain embodiments, the display also shows information about the refrigerant leak detection status, as described herein.

The vending machine 105 includes a payment system 220. The payment system 220 is located on a front face of the vending machine 105, such as on a front portion of the cabinet 205 or on the service door 210. In certain embodiments, the payment system 220 is included within or as part of the user interface 215. The payment system 220 includes one or more of a bill validator, a coin acceptor, a credit or debit card reader, and a cashless payment device reader, such as a reader of fobs, tags, tokens, or quick-response codes (QR codes). The payment system 220 receives currency, coins, or other forms of payment from the customer and returns change as necessary. In certain embodiments, the payment system 220 includes a light for each payment device contained therein that indicates the status of that payment device to a user.

The vending machine 105 includes an access port 225 located on the front face of the enclosure, such as within the service door 210. The access port 225 enables access to a delivery receptacle mounted within the service door 210 or in the cabinet 205. The access port 225 can have a delivery door or other mechanical system (e.g., rotatable delivery receptacle open on one side) for controlling and restricting customer access into the delivery receptacle, an interior of the vending machine, or both. In certain embodiments, particularly when the vending machine 105 is configured as a helical coil snack vending machines, the access port 225 is located at or near a bottom of the vending machine and extends across most of a width of the vending machine 105. In certain embodiments, the access port 225 is disposed below a large glass window allowing a view of products within the cabinet 205 or below a large LCD screen that selectively presents images or videos. In certain embodiments, the aforementioned large LCD screen is the LCD screen of the user interface 215. In certain embodiments, the vending machine 105 includes X-Y product retrieval and delivery mechanisms and a glass or substantially transparent front or a large LCD screen front, but may also include the access port 225 disposed to the side, at a height convenient to the customer for product retrieval without bending over.

Those skilled in the art will recognize that the complete structure of a vending machine 105 is not illustrated in the drawings, and the complete details of the structure and operation of the vending machine 105 is not described in the present disclosure. Instead, for simplicity and clarity, only so much of the structure and operation of the vending machine 105 as is unique to the present disclosure or necessary for an understanding of the present disclosure is illustrated and described.

Figure 3:
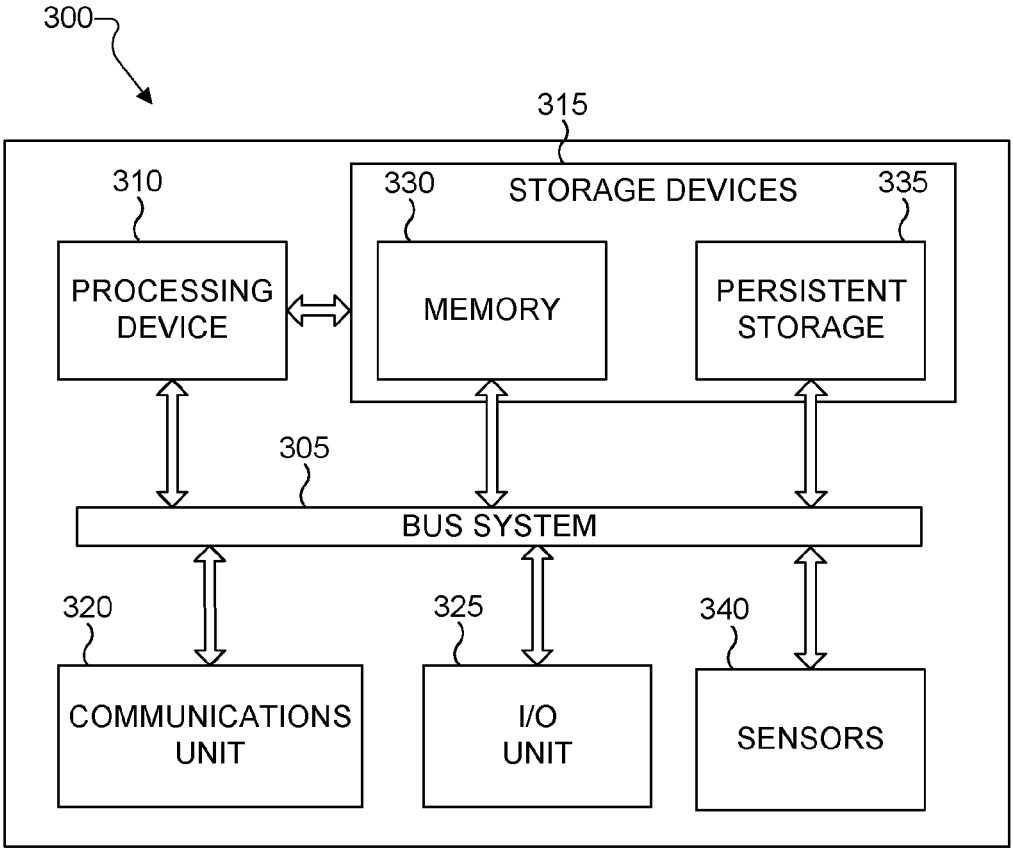
FIG. 3 illustrates exemplary devices in a vending machine system according to this disclosure.

FIG. 3 illustrates exemplary devices 300 in a vending machine system according to this disclosure. As shown in FIG. 3, the device 300 includes a bus system 305, which supports communication between at least one processing device 310, at least one storage device 315, communications unit 320, input/output (I/O) units 325, and sensors 340. At least one storage device 315, memory 330 or persistent storage 335 may be connected with processing device 310 via a high-speed bus. Control equipment can include one or more of the components in device 300.

The processing device 310 executes instructions that may be loaded into a memory 330. The processing device 310 may include any suitable number(s) and type(s) of processors or other devices in any suitable arrangement. Example types of processing devices 310 include microprocessors, microcontrollers, digital signal processors, field programmable gate arrays, application specific integrated circuits, and discreet circuitry. The processing device 310 may be configured to process and report leak detection in the vending machine system.

The memory 330 and a persistent storage 335 are examples of storage devices 315, which represent any structure(s) capable of storing and facilitating retrieval of information (such as data, program code, and/or other suitable information on a temporary or permanent basis). The memory 330 may represent a random access memory or any other suitable volatile or non-volatile storage device(s). For example, the memory 330 could be a pattern of fixed resisters on apiece of silicon. The persistent storage 335 can contain one or more components or devices supporting longer-term storage of data, such as a ready only memory, hard drive, Flash memory, or optical disc.

The communications unit 320 supports communications with other systems or devices. For example, the communications unit 320 could include a network interface card or a wireless transceiver facilitating communications over a network. The communications unit 320 may support communications through any suitable physical or wireless communication link(s).

The I/O units 325 allows for input and output of data. The I/O units 325 can also be referred to as interfaces. The I/O units 325 can provide a connection to primary and secondary buses as discussed herein. The I/O units 325 can also be used for user input through a keyboard, mouse, keypad, touchscreen, or other suitable input device. The I/O units 325 can also send output to a display, printer, or other suitable output device. There can be additional I/O units in various embodiments.

The sensors 340 can detect different operating parameters of a refrigerated vending machine. The detected readings can be used in different operations and stored in the storage devices 315. Examples of sensors 340 in the refrigerated vending machine can include temperature sensors, pressure sensors, light sensors, gas sensors, etc. The gas sensors can be used to detect a refrigerant leak inside the product storage space 410 in FIG. 4.

The embodiments of this disclosure make use of one or more volatile organic compound (VOC) sensor(s) 340 to detect the presence of these compounds within the environment in which it is located. Each sensor 340 can be powered by AC or DC power supply back up by battery or other means of mobile power supply. The sensor 340 can emit audible sound or visual signal if the backup power supply drops below certain thresholds.

The sensors 340 can detect both threshold and dynamic (analog) levels of any flammable refrigerant or gas (including R290) present in the area where they are placed. The sensors 340 can react if they detect the presence of flammable refrigerant or gas with a concentration level determined by testing to be an appropriate threshold. This may or may not be between what is considered to be the lower and upper explosive limits for the gas. For example, R290 is considered to be flammable in concentrations between 14% (the lower flammable or explosive limit—known as LEL) and 65% (the upper flammable or explosive limit—known as UFL). Below and above these concentration levels, the fuel/air mixture is insufficient to support combustion in the presence of an ignition source. The sensors 340 could raise alarm even if concentration of any flammable refrigerant or gas (including R290) present in the area where they are placed is lower than LEL. The sensors 340 could raise alarm with concentration of any flammable refrigerant or gas (including R290) with some safety margin that may be lower than LEL as location of sensors 340 may not be the location where concentration of any flammable refrigerant or gas (including R290) is the highest.

Figure 4A:
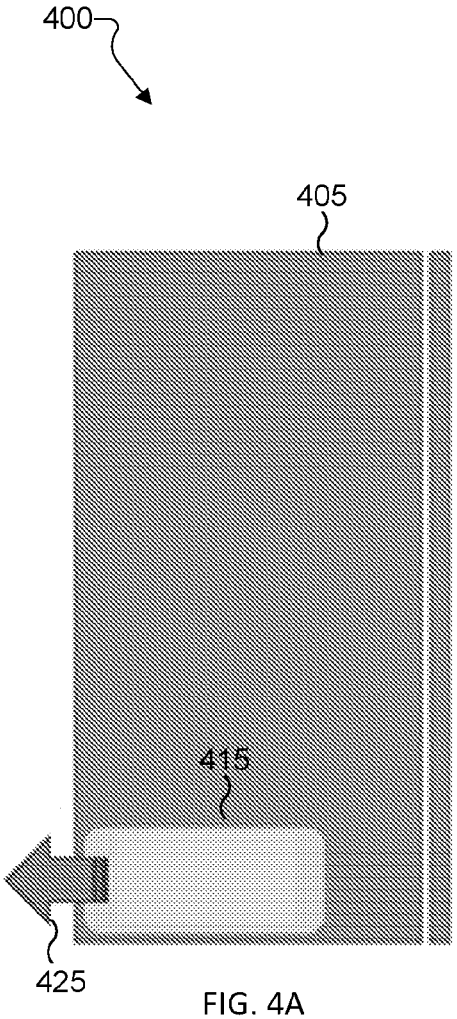
FIGS. 4A and 4B illustrate an exemplary side view and front view of a refrigerated vending machine according to the various embodiments of this disclosure.
Figure 4B:
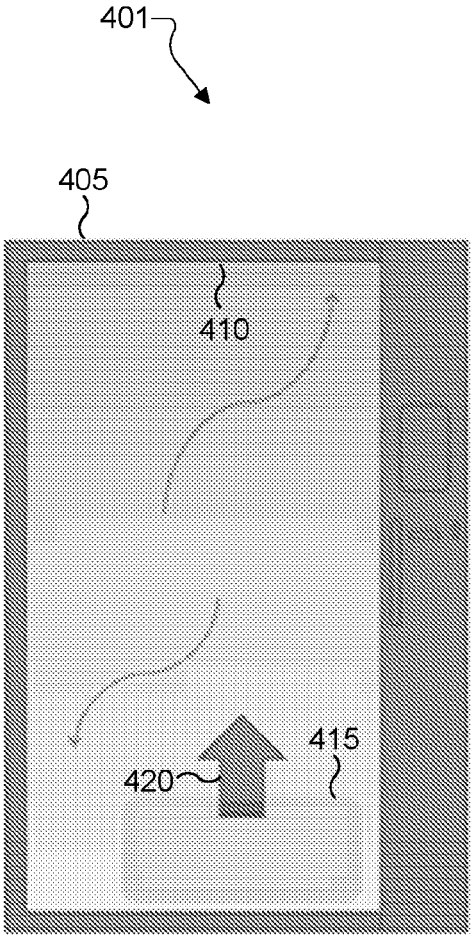

FIGS. 4A and 4B illustrate an exemplary side view 400 and front view 401 of a refrigerated vending machine 405 with a refrigerated product storage space 410 according to the various embodiments of this disclosure. FIGS. 5A-5H illustrate an exemplary refrigerated vending machine bank of vending machines and the airflow pattern in a refrigerated vending machine according to the various embodiments of the present disclosure. Although certain details will be provided with reference to the components of the control system 300 of FIG. 3, it should be understood that other embodiments may include more, less, or different components. The vending machine 105 includes the control system 300, which can correspond to refrigeration system 415. The control system 300 is configured to enable the vending machine 105 to detect a refrigerant leak. The control system 300 and the refrigeration system 415 can input cold air 420 into the refrigerated product storage space 410 and output hot air 425 into the surrounding atmosphere. This disclosure is not limited to embodiments of the refrigerated vending machine of FIGS. 4 and 5.

FIGS. 5A-5H illustrate an exemplary refrigerated vending machine bank 500 of refrigerated vending machines 515 and the airflow pattern 530, 535 in a refrigerated vending machine according to the various embodiments of the present disclosure. The embodiments of the refrigerated vending machine bank 500 and the airflow patterns 530, 535 illustrated in FIGS. 5A-5H are for illustration only. FIGS. 5A-5H do not limit the scope of this disclosure to any particular implementation of refrigerated vending machines.

Figure 5A:
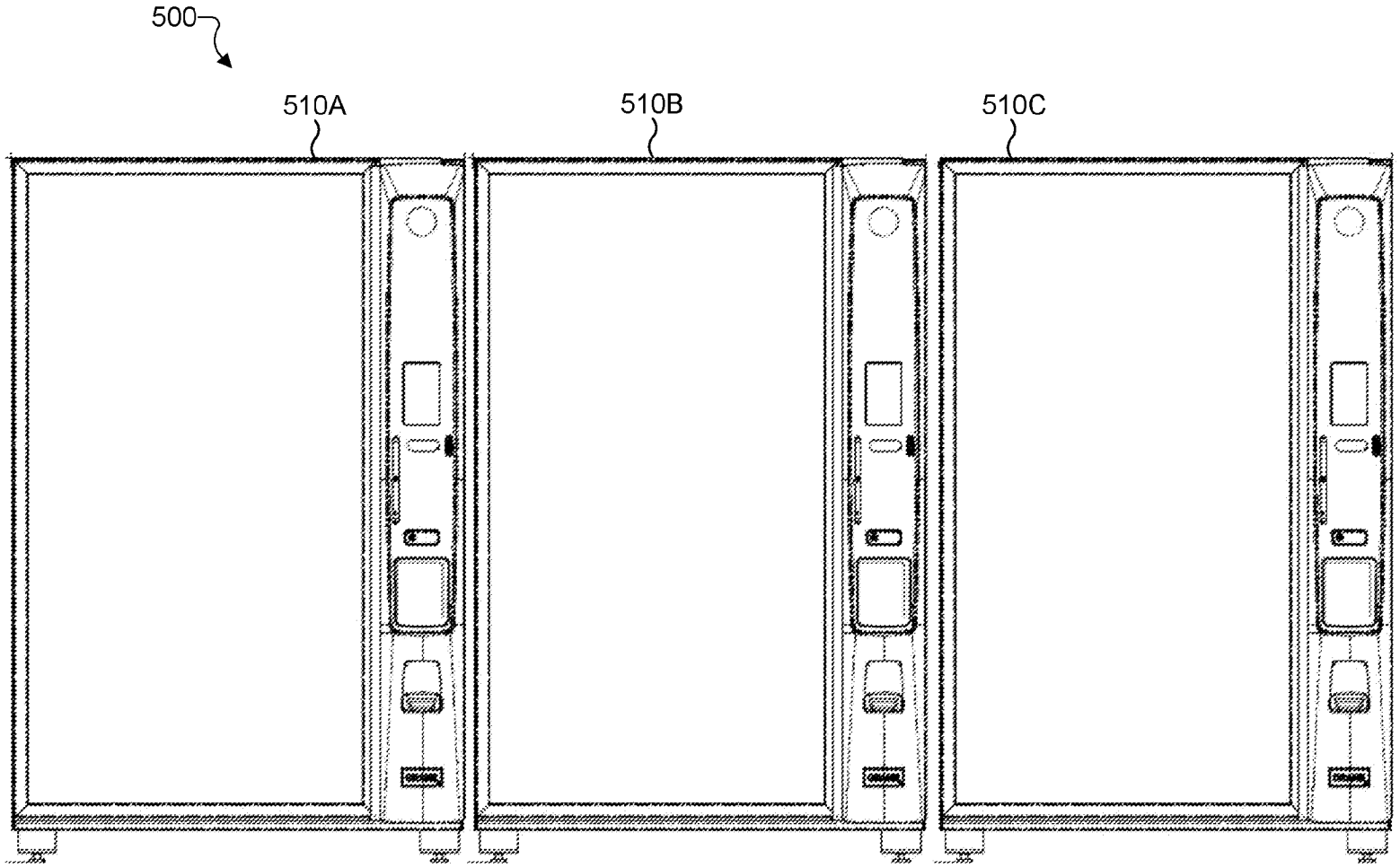
FIGS. 5A-5H illustrate an exemplary refrigerated vending machine bank of vending machines and the airflow pattern in a refrigerated vending machine according to the various embodiments of the present disclosure.
Figure 5C:
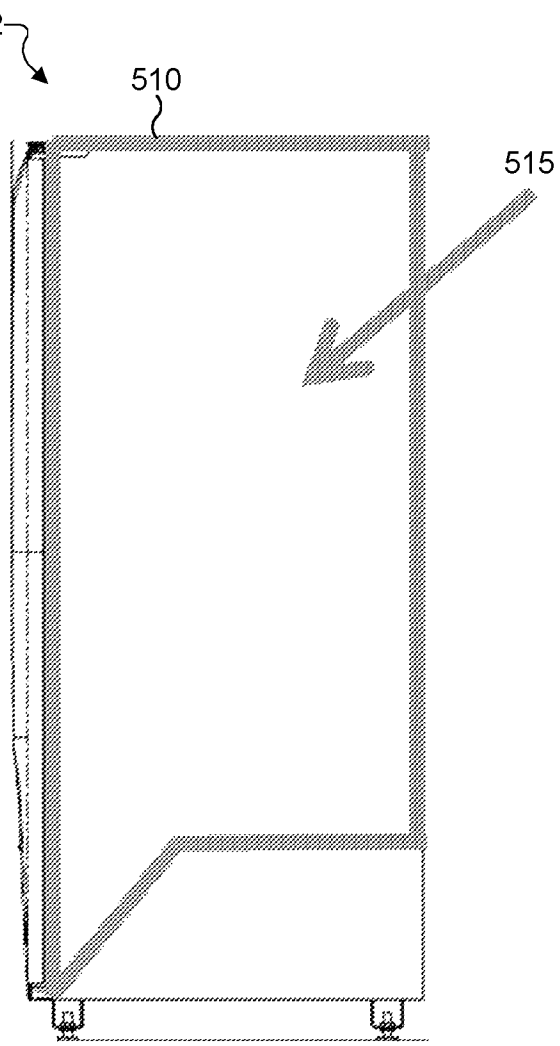
Figure 5B:
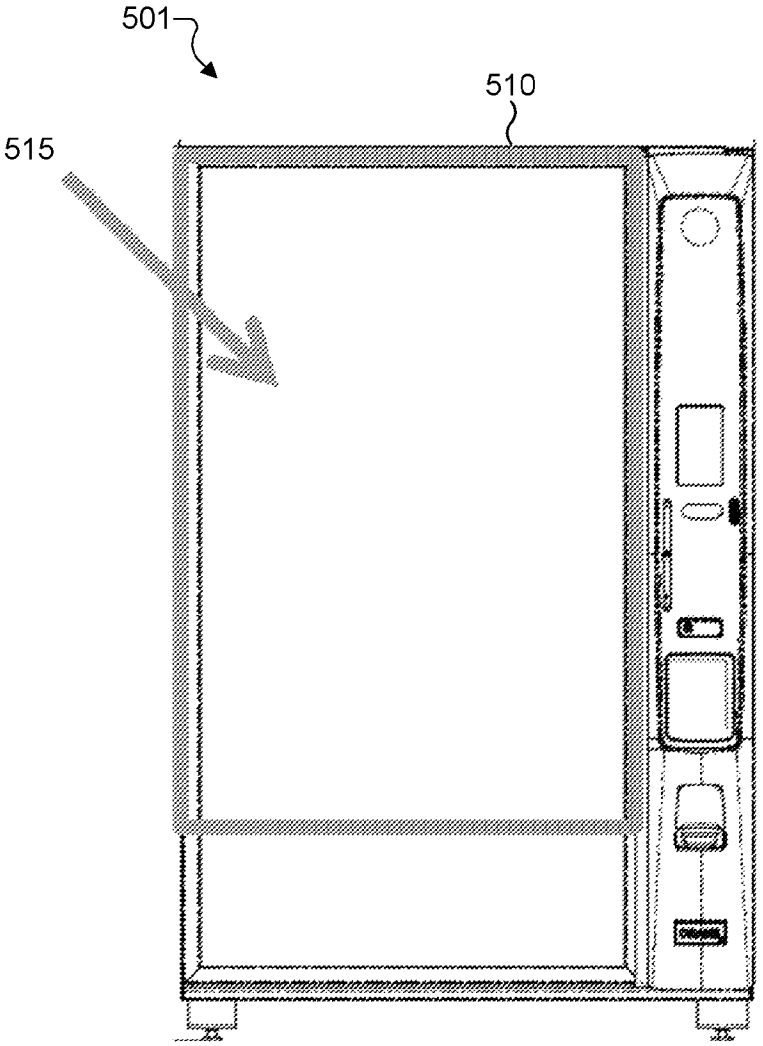
Figure 5D:
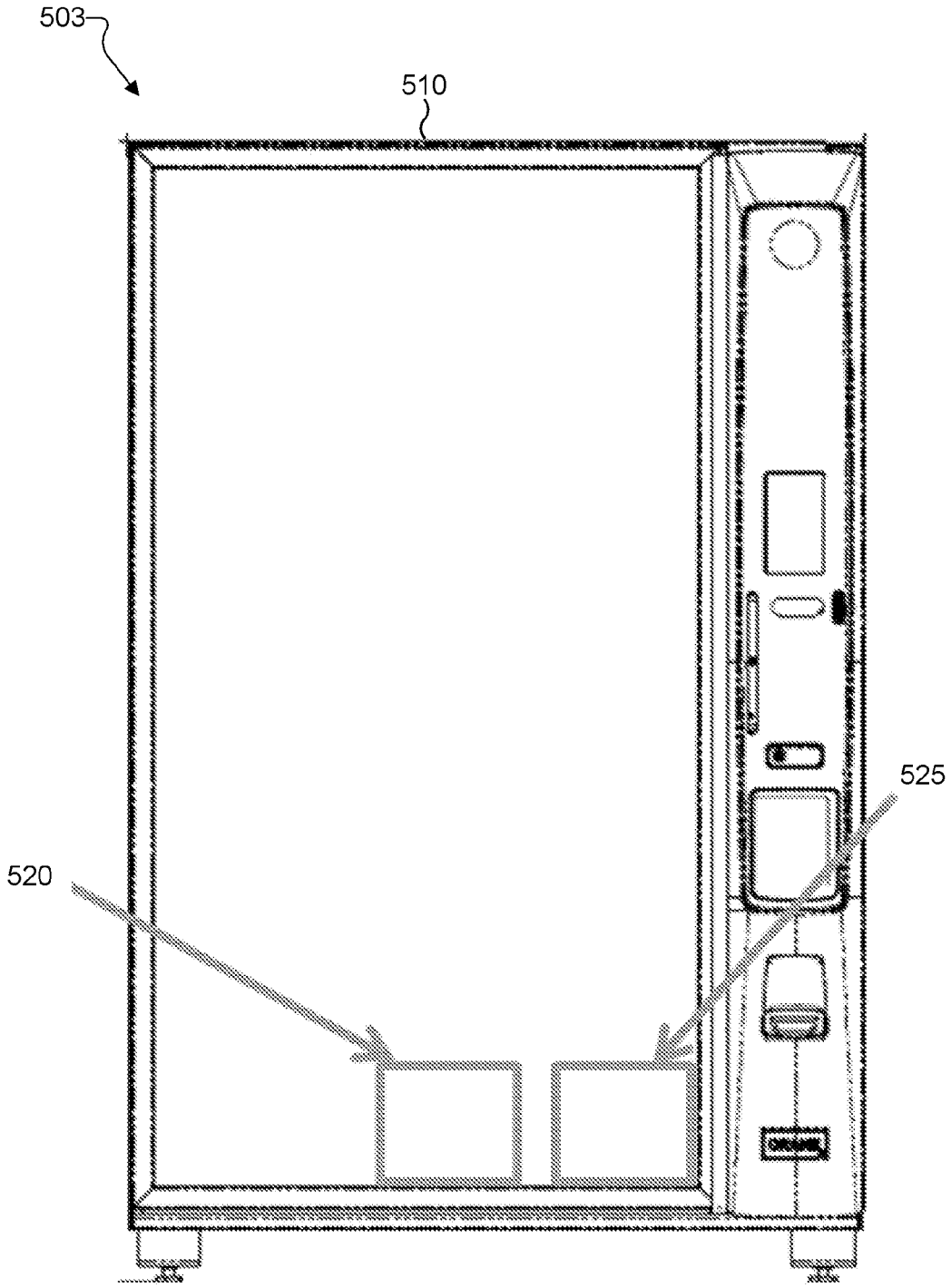
Figure 5F:
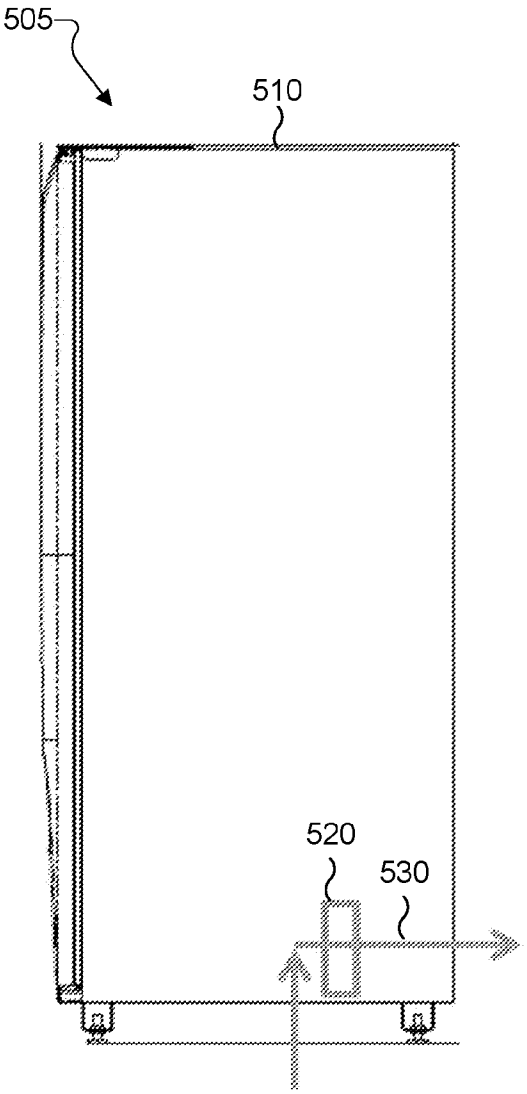
Figure 5E:
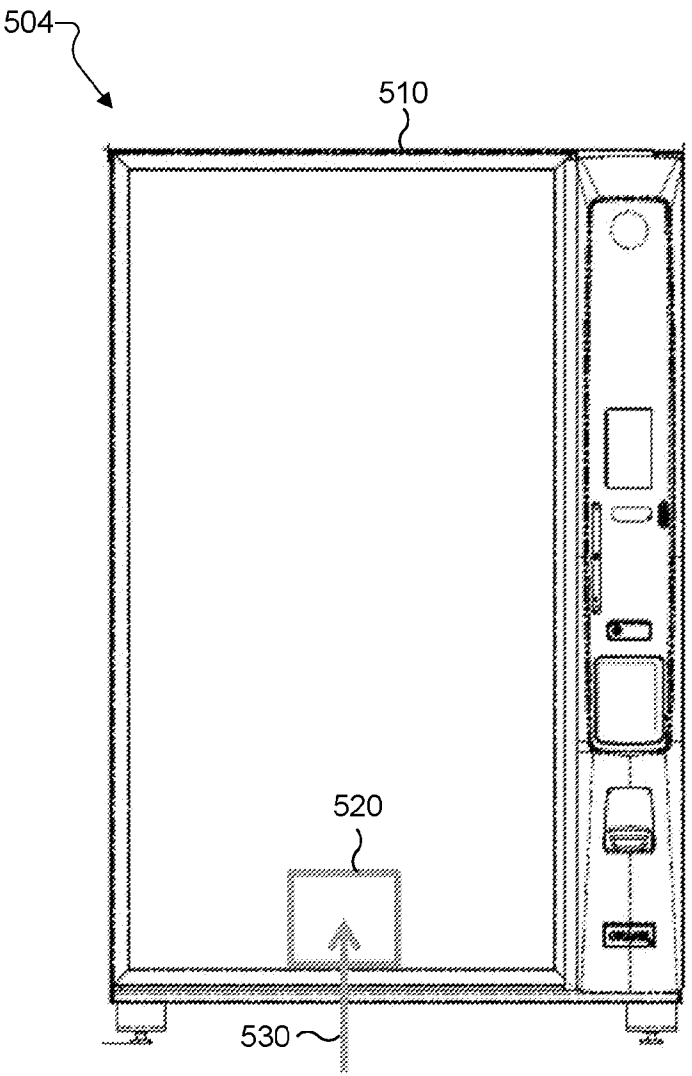
Figure 5H:
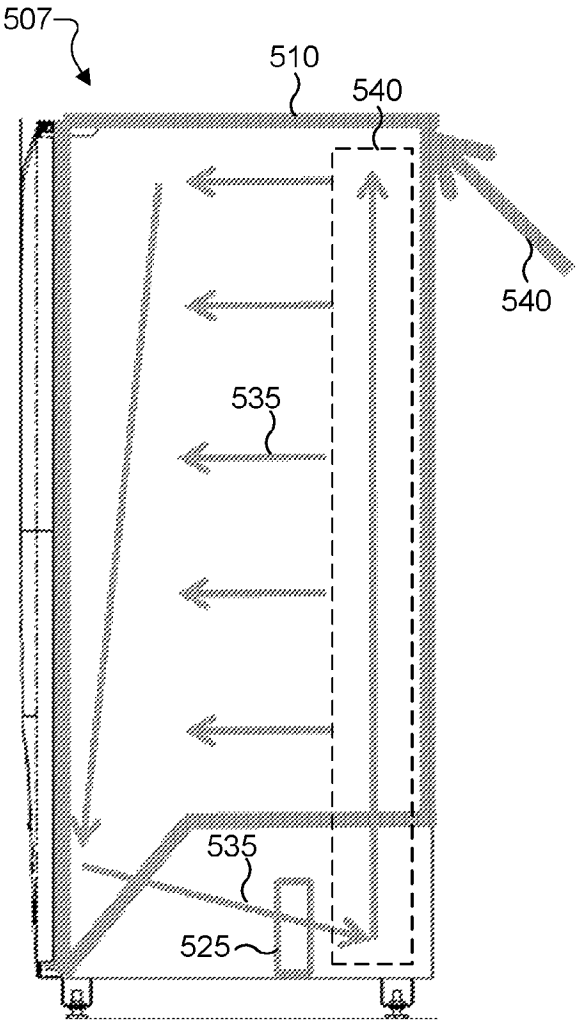
Figure 5G:
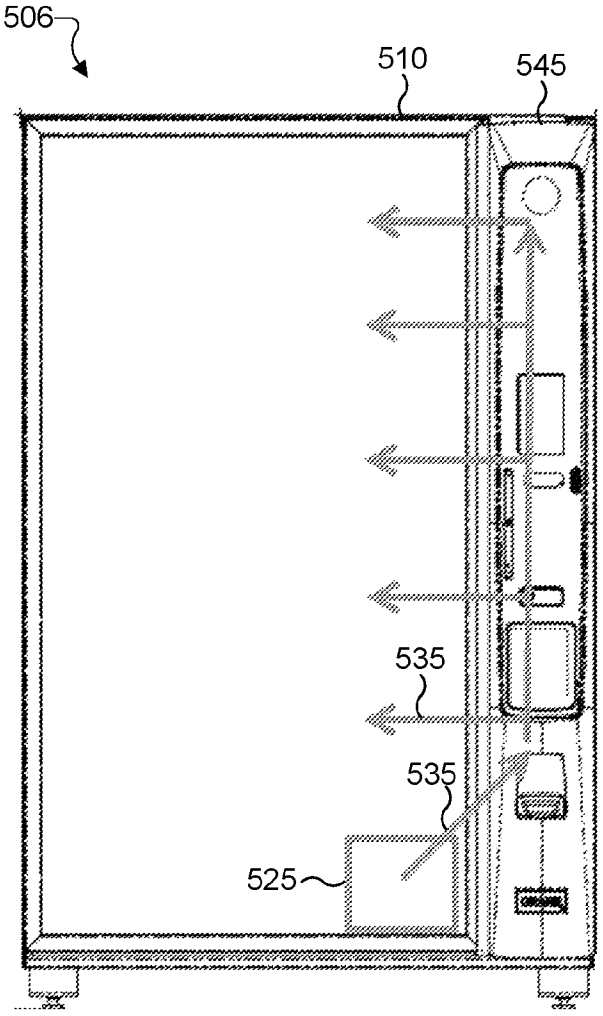

The refrigerated vending machine bank 500 can include a first refrigerated vending machine 515A, a second refrigerated vending machine 515B, and a third refrigerated vending machine 515C. Each of the refrigerated vending machine 515A-515C can operate independently, but also communicate in kind to operate more efficiently. For example, when a refrigerant leak is detected at the first refrigerated vending machine 515A, the first refrigerated vending machine 515A can transmit a notification of the detected leak to the second refrigerated vending machine 515B and the third refrigerated vending machine 515C before shutting down. The second refrigerated vending machine 515B and the third refrigerated vending machine 515 can shut down based on the notification or can remain operating until the refrigerant leak is detected at the specific unit. While three refrigerated vending machines are illustrated in FIG. 5A, any amount of refrigerated vending machine can be included in a refrigerated vending machine bank 500.

Each refrigerated vending machine 515 can include a refrigerated area 515, a condenser fan 520, and an evaporator fan 525. The cooling air 535 from the evaporator fan 525 is directed to the right of the refrigerated vending machine 515 and ducted upward as it exits the evaporator fan 525. The refrigerated air duct 540 passes behind a separate electrical service compartment 545, which contains the vending machine controller, power supply, and other electrical components. The cooling air 535 exits the vertical duct 540 back into the refrigerated area 515 and passes over horizontal trays that contain vending product. This air then recirculates back to the evaporator at the bottom of the machine for further cooling. A machine typically contains baffles, partitions or other means that separate the condenser (hot discharge air 530) and evaporator (cooling air 535) airflow.

Within the vending cabinet there is typically lighting, motors, solenoids or other devices used to control the delivery mechanism which moves to the location of the product to be vended when selected by a customer, captures the product, and moves the product to the discharge for the consumer to retrieve the vended product. The operation of these mechanisms typically employs the use of switches, sensors, and other electrical components that are located within this refrigerated space.

The refrigerated vending machines such as those described may have a single or multiple refrigeration systems. Additionally, the refrigeration systems may have multiple fan motors and compressors. Refrigerated vending machine states covered with this application include stationary, unpowered (storage, machine prep); transit, unpowered (transportation—less than truck load (LTL), full truck load (FTL), ocean container, machine delivery); powered (machine prep, on-location-operational, service condition); under power "sub-states"; normal operation, ready to vend condition, evaporator fan motor(s) runs continuously and compressor and condenser fan motor(s) are on only when called for cooling; normal operation, ready to vend condition with evaporator fan motor(s), condenser fan motor(s) and compressor(s) are on or off depending upon the demand for cooling; full operation—product loading or re-loading condition, which includes compressor and condenser fan on if calling for cooling, compressor turns off and condenser fan turns off with service door switch activation, and evaporator fan turns off when service door is opened; and abnormal operation, compressor cycles on overload, condenser fan runs continuous.

Vapor compression refrigeration systems have both a "high-side" and a "low-side" to the refrigeration system. The "low-side" (evaporator) of the system absorbs heat from the surrounding environment and cools the surrounding space, the refrigerated space or product storage area of the vending machine. The "high-side" (condenser) of the system gives up the absorbed heat to the surrounding environment. Refrigerant, in this case in the form of R290 (propane) flows through the system changing phase as it absorbs and releases this heat energy.

Several principal areas can be impacted in the case of a leak or release of refrigerant depending on the construction of the vending machine. A "low-side" leak may discharge refrigerant into the refrigerated or product storage space where the evaporator is located. A "high-side" leak may discharge refrigerant into the space where the compressor and condenser coil are located. In general, the refrigerated space is sealed to prevent any air leakage (thermal losses) from refrigerated space to the outside atmosphere or vice versa. However, they are not completely "air-tight" and some air/gas migration does occur under normal conditions. This refrigerated space may contain mechanical and electromechanical mechanisms that allow product stored in this space to be retrieved and delivered to the consumer. As determined by established and recognized code and regulatory bodies such as underwriters laboratories (UL), machines that utilize flammable refrigerant must use components in this space that are spark or ignition proof or otherwise protected from contact with the gas. The "high-side" typically discharges to the surrounding atmosphere. The same as in case of the low side area, as determined by established and recognized code and regulatory bodies such as UL, machines that utilize flammable refrigerant must use components in this space that are spark or ignition proof or otherwise protected from contact with the gas.

Placement and number of the sensors is important to the ability of the device to take responsive action. Given that a leak could occur from either the "high-side" or "low-side" of the system multiple sensors might be placed in multiple locations near these potential areas of discharge or other spaces within or surrounding the machine. Multiple sensors could be used to detect threshold levels of releases or to monitor and report concentration levels and release rates all of which could allow for different responsive actions. The use of multiple sensors could also allow the system to monitor each sensor independently or in parallel and take specific action in response to the levels being reported. Individual or multiple sensors could be used to determine the leak rate and potential severity of a release. If a leak occurs on either the "high-side" or "low-side" of the system, placement of a sensor within this space could detect this release at a threshold level well under the LEL and take responsive action (described below). If a leak were to occur from adjacent equipment, appliances or devices utilizing similar flammable refrigerants, sensors placed outside the machine could detect this release and take responsive action.

Potential responsive actions depend on the construction of the machine, which can include several responsive actions also depending on the state of the machine, powered or un-powered. In an unpowered state, the potential responsive actions include powering a"warning" light to alert personnel of a refrigerant leak or release, and not allowing the vending machine to power up when plugged in. In a powered state, the potential responsive actions include disconnecting power to the vending machine entirely; turning off power to all systems controlling payment and consumer interface; turning off all power to the vending machine mechanisms and other electrical or electronic devices; turning off the compressor depending on location of the leak, determined using multiple sensors to detect release levels at different locations of the vending machine; turning on fans within the system (such as within the evaporator or condenser) independently or in parallel; neutralize the gas by injection of an inert gas or fire suppressant into the release space lowering the concentration level below LEL; eliminating the leaked/released refrigerant by directed discharge through an opening or a portal to the outside ambient allowing the refrigerant to disperse and diffuse into the surrounding atmosphere (while hydrocarbon is heavier than air and would normally seek a level near the ground, in a contained space with a fan running, the refrigerant may tend to be dispersed more evenly within the confined space. Discharging this mixture as high as possible in the machine can allow for maximum dissipation and diffusion in the surrounding air); and displaying an audible or visual alarm or notification on the consumer interface of the machine.

The above description seeks to provide an additional measure of hazard mitigation arising from the deployment of flammable refrigerants in an industry and marketplace that has never encountered this hazard in vending equipment. The deployment of sensors and actions taken in response to detection could be determined by inspection and testing of a sample machine.

Figure 6:
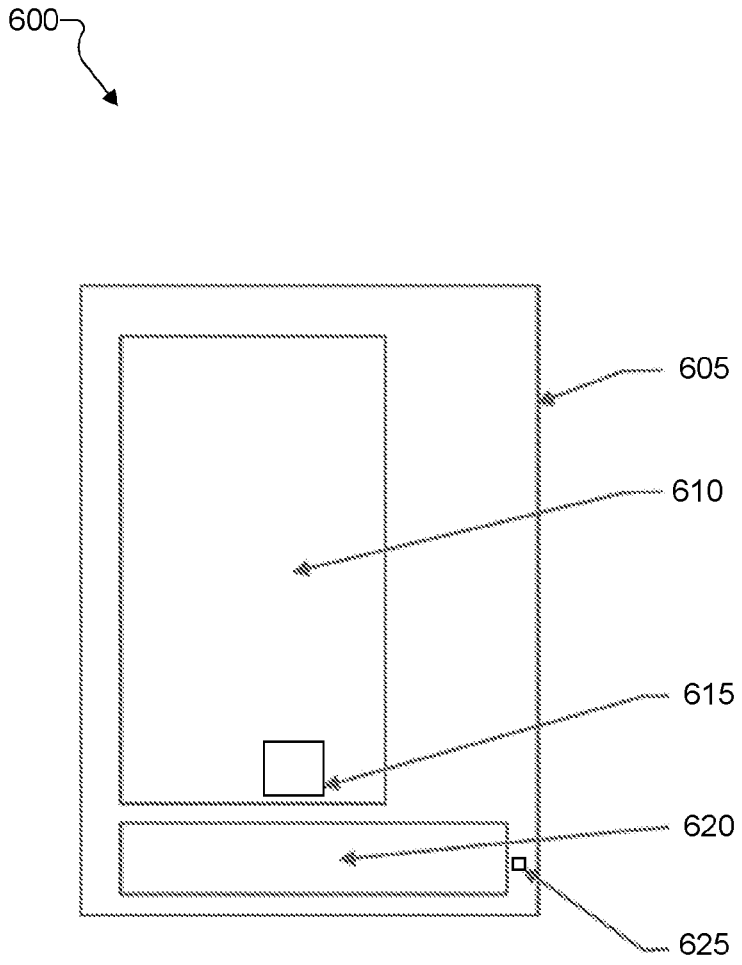
FIG. 6 illustrates an exemplary refrigerated vending machine according to the various embodiments of this disclosure.

FIG. 6 illustrates an exemplary refrigerated vending machine 600 according to the various embodiments of this disclosure. Although certain details will be provided with reference to the components of the control system 300 of FIG. 3, it should be understood that other embodiments may include more, less, or different components. The vending machine 600 includes the control system 300. The control system 300 is configured to enable the vending machine 600 to detect a refrigerant leak. This disclosure is not limited to embodiment of the refrigerated vending machine of FIG. 6.

Within the overall cabinet 605 there is a refrigerated space 610 where for reasons of efficiency ventilation is restricted. And outside of that there is the refrigeration mechanism typically mounted as a removable serviceable module 620 containing the compressor, reservoir, hot and cold heat exchangers etc. Two new elements have been added to the machine. Gas detector 1 is placed in the lower part of the refrigerated compartment. A first gas detector 615 functions to track the accumulation of flammable gas that may occur if the evaporator coil has a slow leak into this space which has limited ventilation. A second gas detector 625 is placed in the lower half of the main cabinet 605 of the vending machine 600 and traces leaks from any other part of the cooling circuit.

Figure 7:
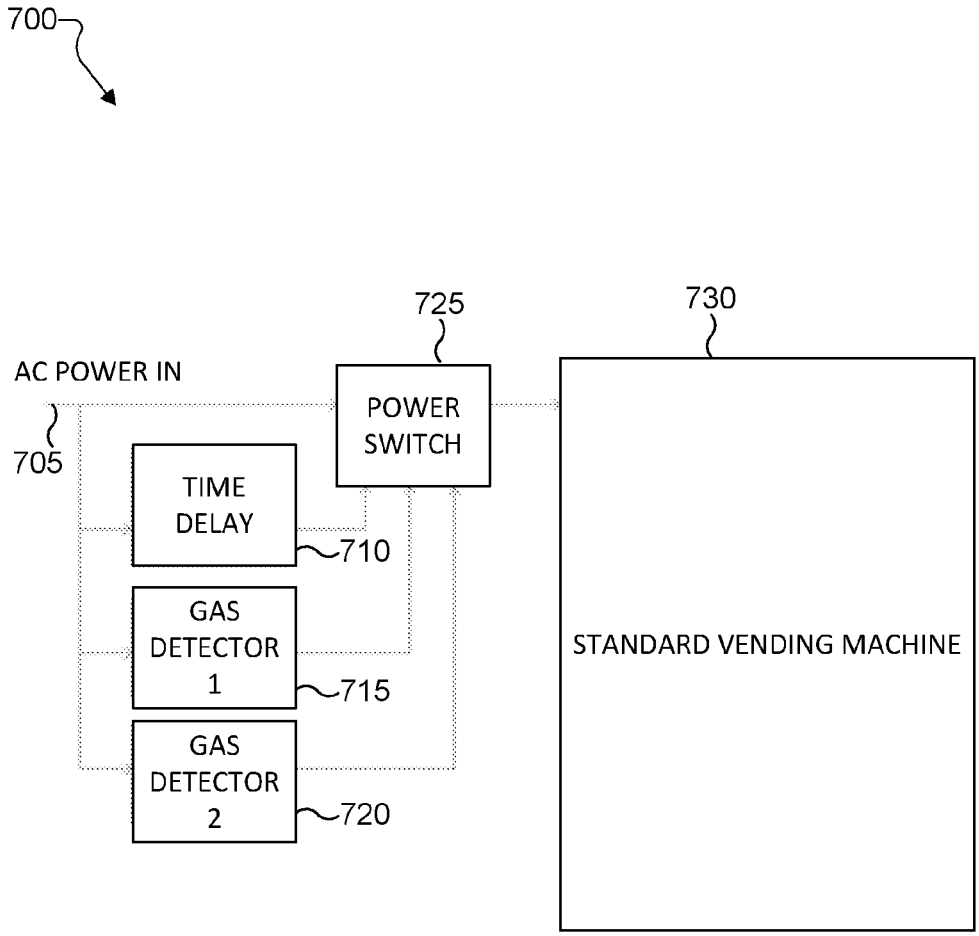
FIG. 7 illustrates an exemplary functional block diagram for a refrigerated vending machine according to the various embodiments of this disclosure.

FIG. 7 illustrates an exemplary functional block diagram for a refrigerated vending machine 700 according to the various embodiments of this disclosure. Although certain details will be provided with reference to the components of the control system 300 of FIG. 3, it should be understood that other embodiments may include more, less, or different components. The vending machine 700 includes the control system 300. The control system 300 is configured to enable the vending machine 700 to detect a refrigerant leak. This disclosure is not limited to embodiments of the refrigerated vending machine of FIG. 7.

The refrigerated vending machine 700 can include an alternating power (AC) power in (input power 705), a time delay 710, a first gas detector 715 (similar to the first gas detector 615), a second gas detector 720 (similar to the second gas detector 620), a power switch 725, and a standard vending machine 730. While illustrated as outside the standard vending machine 730, each of the time delay 710, the first gas detector 715, the second gas detector 720 and the power switch could be located inside the cabinet, on the cabinet, or external to the cabinet.

Input power is no longer connected directly to the vending machine but instead it feeds the vending machine via an electronically controlled switch, such as a GFCI switch. Input power 705 is permanently applied to the two gas detectors 715, 720 and a time delay element 710 (used only at the time of connection to external power). When the input power 705 is applied, the gas detectors 715, 720 and the power up time delay 710 are energized. The electronic power switch 725 can monitor the output from the time delay 710 and the gas detectors 715, 720. Once all three inputs are in the 'safe' state (i.e., no gas detected and the time delay is complete) the electronic power switch 725 can turn on the rest of the vending machine 730. Should the gas detectors register an alarm at any later period of time, the electronic power switch 725 can turn off.

Figure 8:
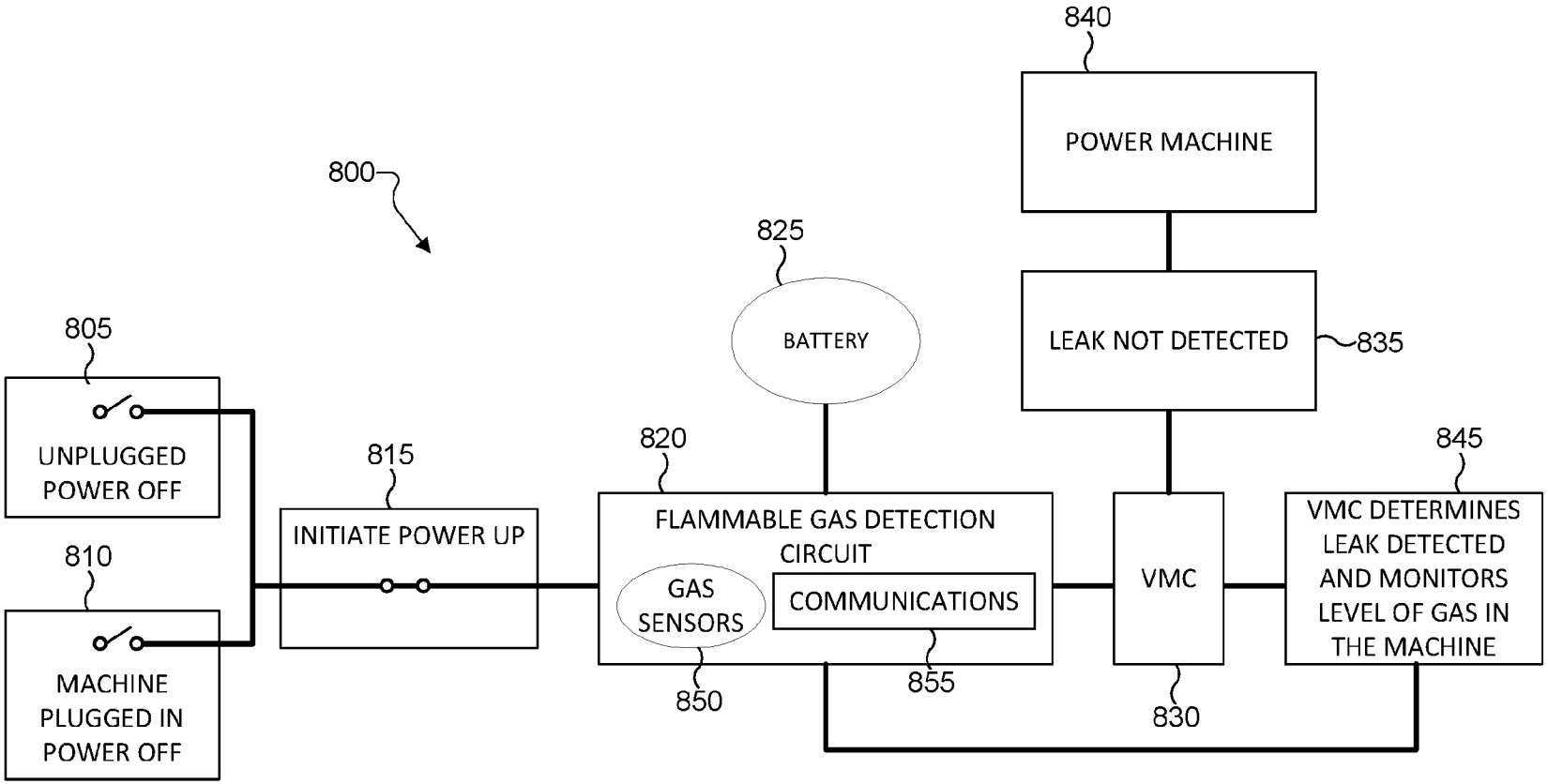
FIG. 8 illustrates an exemplary flammable gas detection circuit according to the various embodiments of this disclosure.

FIG. 8 illustrates an exemplary flammable gas detection circuit 800 according to the various embodiments of this disclosure. The embodiments of the flammable gas detection circuit 800 illustrated in FIG. 8 is for illustration only. FIG. 8 does not limit the scope of this disclosure to any particular implementation of refrigerated vending machines.

The flammable gas detection circuit 800 provides the hardware for detecting refrigerant or other potentially explosive gases in proximity to the refrigerated vending machine. The flammable gas detection circuit 800 can include unplugged detection circuitry 805, power off detection circuitry 810, initiate power up circuitry 815, flammable gas detection circuitry 820, a battery 825, a vending machine controller (VMC) 830, a no leak detected circuitry 835, power machine circuitry 840, and gas level monitoring circuitry 845.

The unplugged detection circuitry 805 can determine that the system is currently unplugged and can determine when the system is plugged in to an exterior power supply. The unplugged detection circuitry 805 can indicate when the refrigerated vending machine is plugged in.

The power off detection circuitry 810 can detect when the refrigerated vending machine is plugged in, but the power is not switched on. The plugged in state of the refrigerated vending machine can be received from the unplugged detection circuitry 805. The power off detection circuitry 810 can indicate when the power is switched on during a plugged in state.

The initiate power up circuitry 815 receives an indication of power up from either the unplugged power circuitry 805 when the power is input from being plugged into an external power supply or the power off detection circuitry 810 when the power is switched on and the refrigerated vending machine was previously plugged into an exterior power supply. The initiate power up circuitry 815 can supply power to specific components of the refrigerated vending machine, such as the flammable gas detection circuitry 820, the battery, 825, the VMC 830, etc. without powering the full refrigerated vending machine.

The flammable gas detection circuitry 820 can detect flammable gases using gas sensors 850 or communication circuitry 855. The flammable gas detection circuitry 820 transmits a signal to the VMC circuitry indicating the detection of flammable gases.

The battery 825 can be attached directly to the flammable gas detection circuitry 820. The battery 825 can operate when the refrigerated vending machine is not plugged in or when the external power supply is not powering the refrigerated vending machine. The function of the battery is to provide sufficient power to operate the flammable gas detection circuitry 820 when power is not supplied from an external source or when the power is insufficient to operate. The battery 825 ensures that the detection circuitry operates in a manner that the rest of the refrigerated vending machine will not spark the flammable gases upon regaining power.

The VMC 830 receives the indication from the flammable gas detection circuitry 820 whether flammable gases are detected. The VMC circuitry 830 can send a signal or divert power to either the no leak detected circuitry 835 or the gas level monitoring circuitry 840 based on the results of the flammable gas detection circuitry 820.

The no leak detected circuitry 835 can transfer or switch power to the refrigerated vending machine. The power machine circuitry 840 can power the rest of the electrical components in the refrigerated vending machine.

The flammable gas detection circuitry 820 can further monitor the flammable gases levels in a state that the refrigerated vending machine is not operating. The flammable gas detection circuitry 820 can determine when the level of flammable gases has subsided and send a signal or indication to the flammable gas detection circuitry 845 to resume detection of flammable gases. The flammable gas detection circuitry 820 can also transmit a message with an amount of the monitored level of flammable gases.

Figure 9:
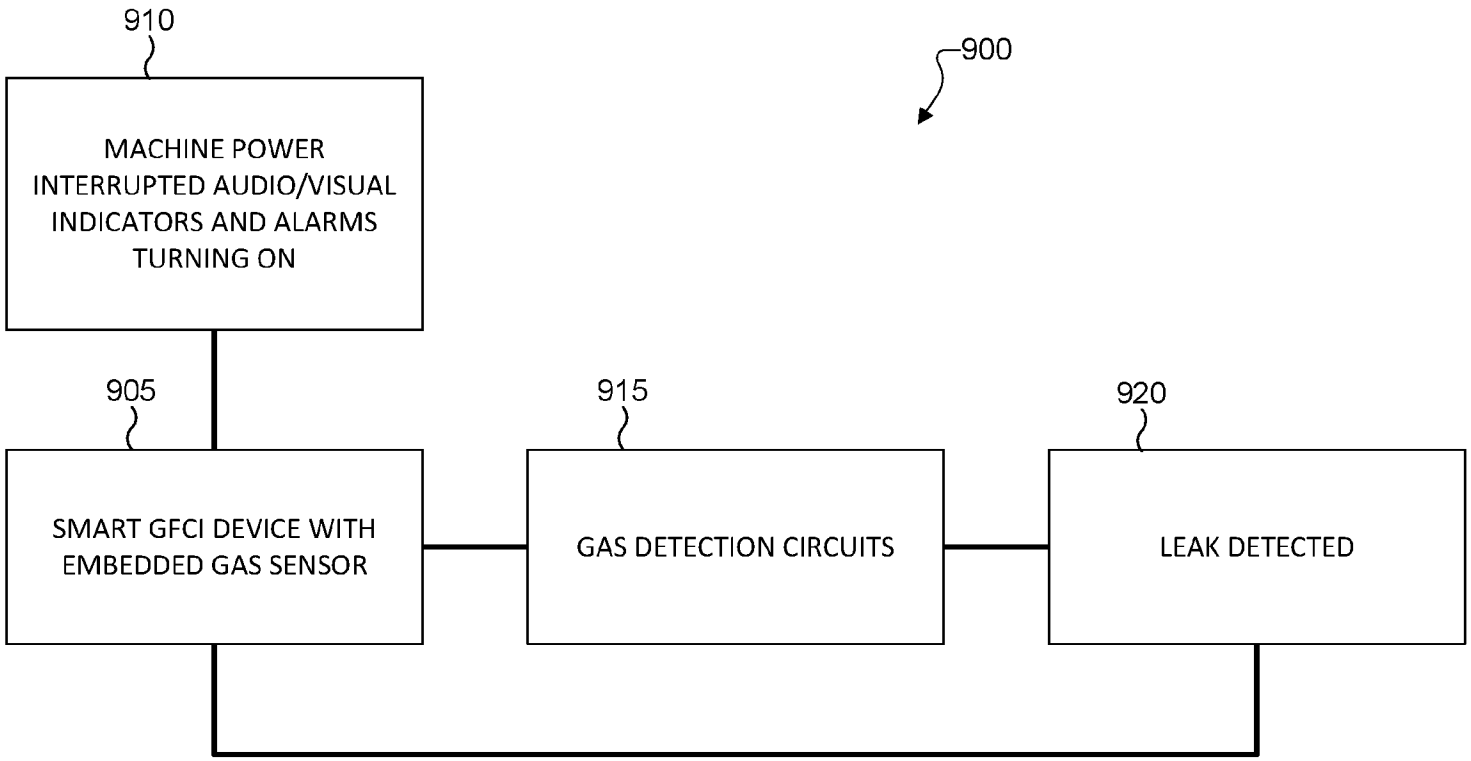
FIG. 9 illustrates an exemplary ground fault circuit interrupter (GFCI) flammable gas detection circuit according to the various embodiments of this disclosure.

FIG. 9 illustrates an exemplary ground fault circuit interrupter (GFCI) flammable gas detection circuit 900 according to the various embodiments of this disclosure. The embodiments of the flammable gas detection circuit 900 illustrated in FIG. 9 is for illustration only. FIG. 9 does not limit the scope of this disclosure to any particular implementation of refrigerated vending machines.

The GFCI flammable gas detection circuit 900 can detect flammable gases using a GFCI during start-up of a refrigerated vending machine. The GFCI flammable gas detection circuit 900 can include a smart GFCI device 905 with an embedded gas sensor, alarm circuitry 910, gas detection circuitry 915, and disconnection circuitry 920.

The GFCI smart device 905 can detect an initial input power applied to the refrigerated vending machine. The GFCI smart device 905 can detect gases using an embedded gas sensor. When a gas is detected, the GFCI smart device can transmit an indication of the detected gas to the alarm circuitry before disconnecting the power from the refrigerated vending machine.

The alarm circuitry 910 receives the indication of detected gas and can provide different audio and visual indicators or alarms to a user. The indications or alarms can continue until manually shut off by the user or when the user can provide maintenance to the refrigerated vending machine removing any potential refrigerant leaks.

The gas detection circuitry 915 can operate as a failsafe to the GFCI smart device. The gas detection circuitry 915 also can operate to detect a refrigerant leak while the refrigerated vending machine is currently running. The gas detection circuitry 915 can also provide an indication that the refrigerant is leaking to the disconnection circuitry 920.

The disconnection circuitry 920 receives an indication from the gas detection circuitry and can disconnect power to the refrigerated vending machine. The disconnection circuitry can also provide an indication the GFCI smart device 905 to active the GFCI switch.

Figure 10A:
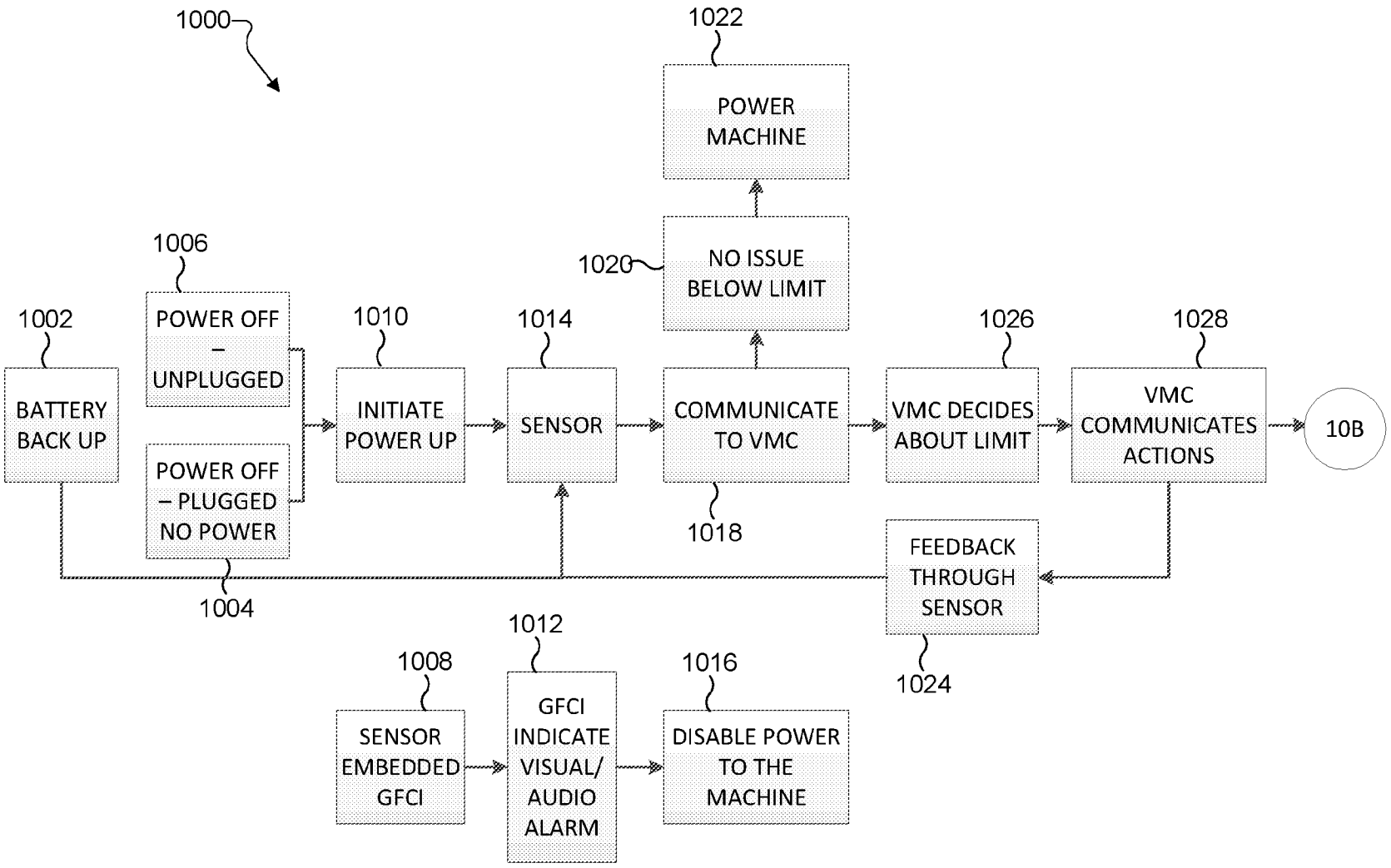
FIGS. 10A and 10B illustrate an exemplary sensor flow chart according to the various embodiments of this disclosure.
Figure 10B:
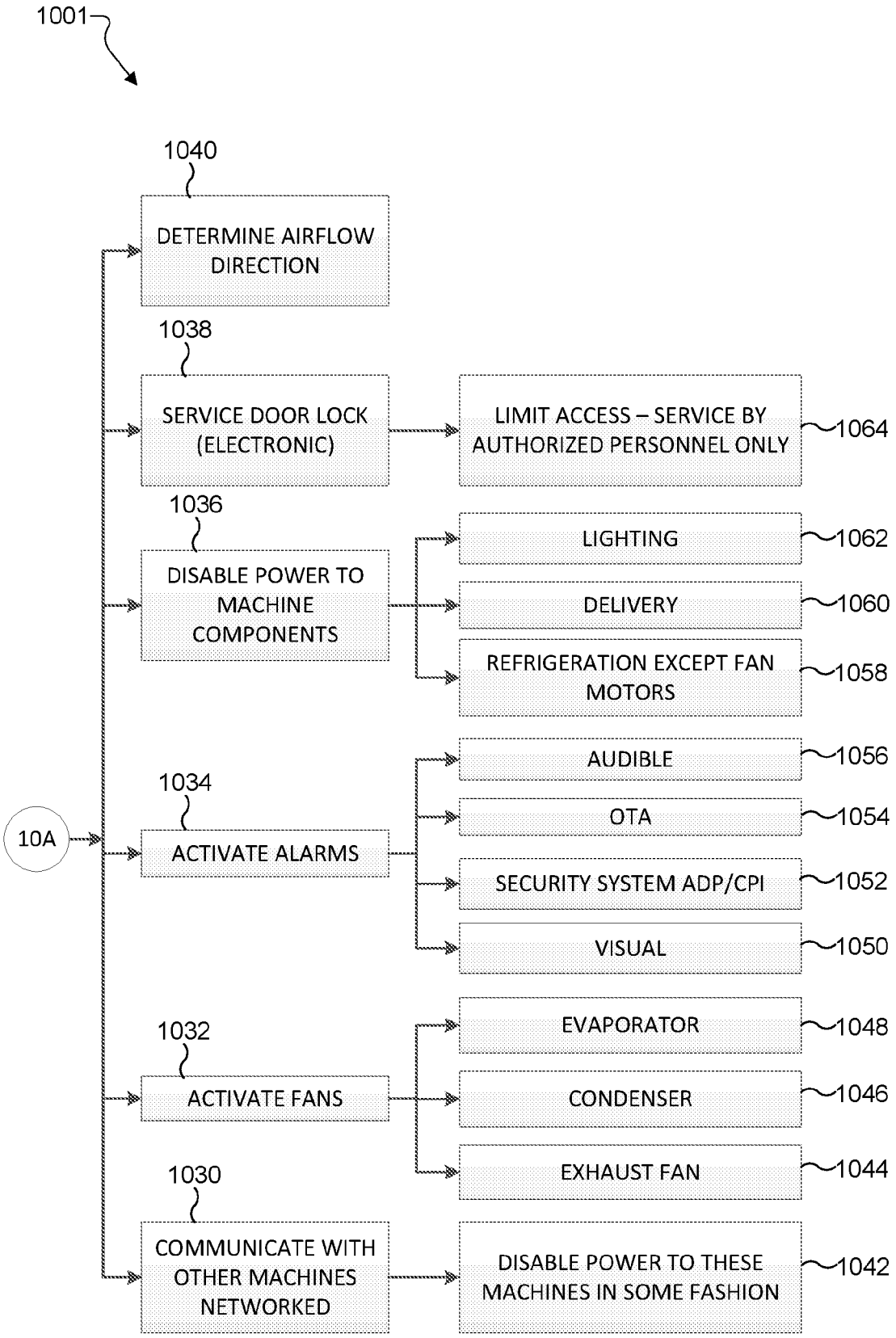

FIGS. 10A and 10B illustrate an exemplary sensor flow chart 1000, 1001 according to the various embodiments of this disclosure. The embodiments of the sensor flow chart 1000, 1001 illustrated in FIGS. 10A and 10B are for illustration only. FIGS. 10A and 10B do not limit the scope of this disclosure to any particular implementation of refrigerated vending machines.

In operation 1002, the refrigerated vending machine can use a battery back-up when power is not supplied. The battery back-up can specifically provide power to gas detection sensors and flammable gas detection circuitry, while not providing power to other components, such as the evaporator, condenser, payment electronics, display, etc.

The sensor circuit can be battery powered or battery backup powered in a manner that the sensor circuit would detect the presence of leaked refrigerant even in the absence of line voltage. The battery power in absence of line power can prevent the powering up of the refrigerated vending machine. The battery power or backup is able to allow the sensor circuit to monitor any leakage when the machine is off, at a standby state, during a power outage, or prior to installation. The battery backup can include an option of automatic or manual on and off switch that can turn it off during transportation.

Operations 1004 and 1006 can occur simultaneously, after operation 1002, or before both of operations 1008 and 1010. In operation 1004, the refrigerated vending machine can be unplugged. In operation 1006, the refrigerated vending machine can be plugged in, but have the power turned off. In either state of operation 1004 or 1006, the refrigerated vending machine does not currently receive power.

Operations 1008 and 1010 can occur simultaneously, after operations 1004 and 1006, or before operations 1012 and 1014. In operation 1008, the smart GFCI device can begin operating an embedded sensor. The embedded sensor can be a gas sensor configured to detect refrigerant leaking in the refrigerated vending machine.

A sensor or feedback circuit to the refrigerated vending machine can be located within the smart GFCI device, where a GFCI device (without additional sensors or feedback circuits) is required in all vending machines by regulatory code. The smart GFCI device can be outfitted with additional lights or audible indicators that could give an indication of the presence of leaked refrigerant. Additionally, if the user attempts to plug in or power up the refrigerated vending machine, a power up could be prevented.

In operation 1010, the refrigerated vending machine can initiate power up or have an initial input power applied. The input power can be received by either plugging in the refrigerated vending machine or by switching the refrigerated vending machine to an on state when already plugged in. The refrigerated vending machine can also be restarted after a power outage or power interruption.

Operations 1012 and 1014 can occur simultaneously, after operations 1008 and 1010, or before operations 1016 and 1018. In operation 1012, the smart GFCI device can provide a visual or audio indication or alarm that a refrigerant leak or gas is detected. The alarm can indicate to a user that a refrigerant leak has occurred or been detected for required review and maintenance.

In operation 1014, the sensor can detect potential gas leaks. The sensor can detect the gas composition in the refrigerated vending machine. If a refrigerant or flammable gas is detected in the cabinet of the refrigerated vending machine, the sensor can indicate the detection. The sensor can be initially powered by the battery backup or can be electrically isolated by a switch. In other words, a switch can be located between the sensor and the other electrical components of the refrigerated vending machine to ensure that combustible gases or refrigerant do not combust during the initial startup of the refrigerated vending machine. The sensors can be located in and around the refrigerated vending machine and placed at various locations to complete checking for any leaked flammable refrigerant. If a sensor detects the presence of the refrigerant in or around the vending machine at a level higher than a predetermined concentration level, the refrigerated vending machine can perform the following operations.

Operations 1016 and 1018 can occur simultaneously, after operations 1012 and 1014, or before operation 1026. In operation 1016, the smart GFCI device can disable power to the refrigerated vending machine. The smart GFCI device can also be used to detect a short circuit in the refrigerated vending machine, but can have a gas sensor embedded allowing for disconnecting when a refrigerant leak is detected.

In operation 1018, the refrigerated vending machine can communicate to the VMC the determination of a refrigerant leak. The VMC can limit or delay power to the electrical components in the refrigerated vending machine other than the sensors.

When a refrigerant leak is detected, the refrigerated vending machine uses the VMC to decide if the leak is over a limit in operation 1026. The limits can be based on combustible temperature of a specific refrigerant and a safety operating factor. When a refrigerant leak is not detected, the refrigerated vending machine can determine that the gas levels are below the safety limit in operation 1020 and release power to the refrigerated vending machine in operation 1022.

In operation 1028, the refrigerated vending machine communicates an action through the VMC. The VMC can communicate feedback through to the sensor in operation 1024. Other actions the VMC can communicate include communicating with other networked machines in operation 1030, activate fans in operation 1032, activate alarms in operation 1034, disabling power to different machine components in operation 1036, servicing a door lock in operation 1038, and determining an airflow direction in operation 1040.

In operation 1030, the refrigerated vending machine can communicate with other networked machines, such as machines in a refrigerated vending machine bank. The machines can be wired or wirelessly connected. The refrigerated vending machine can detect a refrigerant leak and communicate the detected leak with other refrigerated vending machines. The other refrigerated vending machine in vicinity can disable their power in some fashion in operation 1042. As an example, the other refrigerated vending machines can determine that certain electronic components do not create an opportunity to combust a gas based on features such as protective covering of the electronic device or amount of power delivered to the electronic device. The refrigerated vending machines can turn off individually or after a certain amount of refrigerated vending machines or a percentage of connected refrigerated vending machines detect the refrigerant leak. The other refrigerated vending machines can also reduce threshold levels for a refrigerant leak when already detected by a first refrigerated vending machine.

If the refrigerated vending machines are networked and able to communicate with each other, the sensor can send the signals to the controls systems of each refrigerated vending machine and communicate the information to the refrigerated vending machines in the refrigerated vending machine bank or at a specific location. The communication between refrigerated vending machines can indicate to turn off the entire refrigerated vending machine bank or equipment to prevent any spark generation from any other nearby machines or appliances in the event of a refrigerant leak. For the communication, the refrigerated vending machines can be connected wired or wirelessly using Wi-Fi, Bluetooth, etc.

In operation 1032, the refrigerated vending machine can activate different fans. The fans can provide circulation of air to determine whether the leak can be reduced or dispersed to safe levels. The refrigerated vending machine can cycle through activating the exhaust fan 1033, activating the condenser fan in operation 1046, and activating the evaporating fan in operation 1048. The activation of different fans can potentially reduce the refrigerant levels detected and can also be used to identify where the refrigerant leak is located.

The refrigerated vending machine can turn the evaporator and condenser fans on to dissipate any of the accumulated refrigerant (such as R290) in or around the vending machine areas. For this, the sensor can provide concentration level readings to the control system and the control system can turn on one or both of the evaporator and condenser fans. The evaporator and condenser fans could be of a variable speed variety and can operate in conjunction with the sensors to allow for the refrigerant to be expelled or dispersed at an optimum rate that would keep the leaked refrigerant at or below the LFL or a predetermined level. Depending on the concentration level as determined by the sensors and the rate possibly being different in different areas, the fans can be turned on selectively through the control systems. In order to achieve this, a feedback mechanism can be operated between the fan and the control to vary a speed by varying the voltage or other technology, such as a pulse width modulation (PWM) can be operated.

The refrigerated vending machine can operate exhaust fans, which are separate from the evaporator and condenser fans. The exhaust fans can be installed in the machine compartments and be activated upon detecting the presence of a leaked refrigerant. The exhaust fans could be located at the top of the machine to disperse the leaked refrigerant to a greater extent when expelled. The leaked gas can be dispersed at a controlled rate depending upon the concentration levels as determined by the sensors. The higher the concentration of leaked refrigerant detected by the sensor can adjust the exhaust fan to provide a higher rate of dispersion to maintain a concentration below a predetermined level. A feedback mechanism can be implemented between the fan and control system to provide a variable control of the exhaust fan. The adjustment of the exhaust fan can also be controlled using a variable CFM fan or the power can be switched on and off for respective periods of times.

In operation 1034, the refrigerated vending machine can activate a visual alarm in operation 1050, activate a security system in operation 1052, activate an over the air (OTA) in operation 1054, and activate an audible alarm in operation 1056. The alarms can be activated to alert a user to a refrigerant leak.

The refrigerated vending machine can activate an indicator of some type of either visual (such as a message on display, light, etc.), audible (signal, chime, alarm, etc.), or communicative (message through OTA to machine owner, building security system, fire department, etc.). The signal can be transmitted to the control system. The control system can execute one or more of the alerts listed above. A visual display can be displays on a touch screen, or alphanumeric, or graphics display. An audible warning can be generated through a piezo or speaker. An OTA can require the refrigerated vending machine to be connected to a network in order to alert potential user of potential presence of a leaked refrigerant inside or around the cabinet.

In operation 1036, the refrigerated vending machine can disable power to specific machine components, such as disabling power to the refrigeration system excluding the fan motors in operation 1058, disabling the delivery components in operation 1060, and disabling the lighting components in operation 1062. The refrigeration system, delivery components, and lighting can consume a significant amount of energy that could potentially combust a leaked refrigerant. The different systems could also produce enough heat to potentially combust a leaked refrigerant.

In operation 1038, the refrigerated vending machine can service a door lock. The refrigerated vending machine can lock the door to limit access to be serviced by authorized personnel in operation 1064. A refrigerant leak could require experience in dealing with the different flammable gases. The refrigerated vending machine could lock the door to ensure that the refrigerant is contained and does not leak outside of the cabinet.

When the refrigerated vending machines are equipped with electronic door locks, the door lock could be enabled to prevent anyone but a certified servicer from accessing the machine. In case of leaks in the refrigerated compartment, the electronic door locks can prevent gas from escaping from the confined space to outside the cabinet where other potential spark sources may be present. The electronic door lock also ensures that only authorized personnel can open and access the cabinet and quarantine the area appropriately.

In operation 1040, the refrigerated vending machine can determine if the airflow direction affects the refrigerant leak. Control of the different fans to change airflow direction could help identify the location of the leak or potentially reduce the exposure of the leak to the inside of the cabinet.

The airflow direction of the condenser fan can be reversed. The reversal of the condenser fan can be achieved with feedback from various sensors based on a predetermined algorithm. The sensors at various position in the cabinet can monitor the gas levels to determine whether a concentration level is increasing or decreasing and can determine a direction of the airflow.

The embodiments of this disclosure provide a combination of the module elements to address multiple use cases including damage in shipping and repair as well as leaks occurring in service. Other approaches considered include:

Detecting refrigerant leak by loss of temperature differential and "pull down" rate in refrigerated cavity. Unable to separate the desired signal from other factors such as thermal mass and initial temperature of a new product load operation. Also, loss only becomes measurable after fluid reservoir is depleted.

Inferring loss of refrigerant from compressor work (i.e. measure motor current) requires a new sensor and only generates a signal after the fluid reservoir is depleted.

Detecting loss of refrigerant by measuring the mass of the reservoir. Requires some degree of motion from the reservoir. Mass change is small relative to containment vessel. Only possible to measure when system is at equilibrium (at rest plus some settling time).

The above application avoids a new and potentially deadly hazard arising from the deployment of a flammable refrigerant in an industry and marketplace that has never encountered this hazard.

One example embodiment can include a vending machine that detects refrigerant leaks. The vending machine includes a main cabinet, a sensor circuit, and control equipment. The sensor circuit is configured to detect a refrigerant leaked in the main cabinet. The process is configured to operate a component of the refrigerated vending machine based on the detected refrigerant.

Another example embodiment can include a vending machine that detects refrigerant leaks is provided. The vending machine includes a main cabinet, a refrigerated compartment, a first sensor circuit, a second sensor circuit, and control equipment. The refrigerated compartment is located in the main cabinet and configured to store chilled goods. The first sensor circuit is configured to detect a refrigerant leaked in the refrigerated compartment. The second sensor circuit is configured to detect a refrigerant leaked in the main cabinet and outside of the refrigerated compartment. The control equipment is configured to disable power to the refrigerated vending machine based on the detected refrigerant.

Another example embodiment can include a vending machine that detects refrigerant leaks is provided. The vending machine includes a main cabinet, a refrigerated compartment, a first sensor circuit, a second sensor circuit, a battery, and control equipment. The refrigerated compartment is located in the main cabinet and configured to store chilled goods. The first sensor circuit is configured to detect a refrigerant leaked in the refrigerated cabinet. The second sensor circuit is configured to detect a refrigerant leaked in the main cabinet and outside of the refrigerated compartment. The battery is configured to provide power to the first sensor circuit, the second sensor circuit and the control equipment. The control equipment is configured to disable external power to the refrigerated vending machine based on the detected refrigerant during startup of the refrigerated vending machine.

In one or more above examples, the component includes a VMC configured to disable power to electrical components of the refrigerated vending machine based on the detected refrigerant.

In one or more above examples, the component is a smart GFCI device with an embedded gas sensor, and the smart GFCI device is configured to disable power to the refrigerated vending machine based on the embedded gas sensor detecting the refrigerant.

In one or more above examples, the smart GFCI device includes an indicator light to display a visual alert and an audible indicator to produce an audible alert in response to the embedded gas sensor detecting the refrigerant.

In one or more above examples, the component includes evaporator and condenser fans configured to dissipate the refrigerant from an inside of the main cabinet and the refrigerated compartment.

In one or more above examples, the sensor circuit is further configured to detect a concentration level of the refrigerant in the main cabinet, and the control equipment is further configured to variably control a speed of the evaporator and condenser fans based on the detected concentration level.

In one or more above examples, a feedback mechanism is configured to variable control the speed of the evaporator and condenser fans.

In one or more above examples, the component includes a visual indicator configured to display a visual alarm based on the detected refrigerant.

In one or more above examples, the component includes an audible indicator configured to generate an audible warning based on the detected refrigerant.

In one or more above examples, the component includes a communicative indicator to transmit an alarm message based on the detected refrigerant.

In one or more above examples, a communications unit is configured to communicatively connect to another refrigerated vending machine.

In one or more above examples, the control equipment is further configured to transmit a signal to the other refrigerated vending machine indicating a detected refrigerant, and power is disabled to other refrigerated vending machine.

In one or more above examples, the control equipment receives a signal from the other refrigerated vending machine indicating that the other refrigerated vending machine detected a leaked refrigerant; and disables power to electrical components of the refrigerated vending machine.

In one or more above examples, the component includes an electronic door lock on a door of the main cabinet, and the electronic door lock is configured to lock the door upon detection of the refrigerant until an authorized personnel unlocks the electronic door lock.

In one or more above examples, the component includes an exhaust fan separate from an evaporator fan and a condenser fan, and the exhaust fan is configured to variably adjust dispersion of the refrigerant.

In one or more above examples, the sensor circuit is further configured to detect a concentration level of the refrigerant in the main cabinet, and the control equipment is further configured to variably control a speed of the exhaust fan based on the detected concentration level.

In one or more above examples, a feedback mechanism configured to variable control the speed of the exhaust fan.

In one or more above examples, the component includes a condenser fan configured to circulate air within the main cabinet, and the control equipment is configured to reverse a direction of the circulated air to reduce a concentration of the refrigerant.

In one or more above examples, a battery configured to power the sensor circuit when input power is not supplied by an external power source.

In one or more above examples, the battery is exclusively connected to the sensor circuit.

It may be advantageous to set forth definitions of certain words and phrases used throughout this patent document. The terms "transmit," "receive," and "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A refrigerated vending machine, comprising:

a main cabinet;

a refrigerated compartment located in the main cabinet and configured to store chilled goods;

a first sensor circuit configured to detect a refrigerant leaked in the refrigerated compartment;

a second sensor circuit configured to detect a refrigerant leaked in the main cabinet outside of the refrigerated compartment;

a transceiver configured to communicatively connect to another refrigerated vending machine; and a control system including a component of the refrigerated vending machine, wherein the component is configured to disable power to the refrigerated vending machine based on the detected refrigerant, wherein the control system is configured to transmit a signal to the other refrigerated vending machine indicating a detected refrigerant and to disable power to the other refrigerated vending machine.

2. The refrigerated vending machine of claim 1, wherein the component is a vending machine controller (VMC) configured to disable power to electrical components of the refrigerated vending machine based on a detected refrigerant leak.

3. The refrigerated vending machine of claim 1, further comprising:

a smart ground fault circuit interrupter (GFCI) device with an embedded gas sensor separate from the first and second sensor circuits, and the smart GFCI device is configured to disable power to the refrigerated vending machine based on the embedded gas sensor detecting the refrigerant.

4. The refrigerated vending machine of claim 3, wherein the smart GFCI device includes an indicator light to display a visual alert and an audible indicator to produce an audible alert in response to the embedded gas sensor detecting the refrigerant.

5. The refrigerated vending machine of claim 1, wherein the component includes evaporator and condenser fans configured to dissipate the refrigerant from an inside of the main cabinet and the refrigerated compartment.

6. The refrigerated vending machine of claim 5, wherein:

the second sensor circuit is further configured to detect a concentration level of the refrigerant in the main cabinet, and the control system is further configured to variably control a speed of the evaporator and condenser fans based on the detected concentration level.

7. The refrigerated vending machine of claim 6, wherein the control system is further configured to variably control the speed of the evaporator and condenser fans based on feedback provided to the control system.

8. The refrigerated vending machine of claim 1, wherein the component includes a visual indicator configured to display a visual alarm based on a detected refrigerant leak.

9. The refrigerated vending machine of claim 1, wherein the component includes an audible indicator configured to generate an audible warning based on a detected refrigerant leak.

10. The refrigerated vending machine of claim 1, wherein the component includes a transceiver to transmit an alarm message based on a detected refrigerant leak.

11. The refrigerated vending machine of claim 1, further comprising an electronic door lock on a door of the main cabinet, wherein the electronic door lock is configured to lock the door upon detection of the refrigerant until receipt of an authorization to unlocks the electronic door lock.

12. A refrigerated vending machine, comprising:

a main cabinet;

a refrigerated compartment located in the main cabinet and configured to store chilled goods;

a first sensor circuit configured to detect a refrigerant leaked in the refrigerated compartment;

a second sensor circuit configured to detect a refrigerant leaked in the main cabinet outside of the refrigerated compartment; and a control system including a component of the refrigerated vending machine, wherein the component is configured to disable power to the refrigerated vending machine based on the detected refrigerant, wherein the component includes an exhaust fan separate from an evaporator fan and a condenser fan, and the exhaust fan is configured to variably adjust dispersion of the refrigerant.

13. A refrigerated vending machine, comprising:

a main cabinet;

a refrigerated compartment located in the main cabinet and configured to store chilled goods;

a first sensor circuit configured to detect a refrigerant leaked in the refrigerated compartment;

a second sensor circuit configured to detect a refrigerant leaked in the main cabinet outside of the refrigerated compartment; and a control system including a component of the refrigerated vending machine, wherein the component is configured to disable power to the refrigerated vending machine based on the detected refrigerant, wherein:

the component includes an exhaust fan separate from an evaporator fan and a condenser fan, and the exhaust fan is configured to variably adjust dispersion of the refrigerant, the second sensor circuit is further configured to detect a concentration level of the refrigerant in the main cabinet, and the control system is further configured to variably control a speed of the exhaust fan based on the detected concentration level.

14. The refrigerated vending machine of claim 1, wherein:

the component includes a condenser fan configured to circulate air within the main cabinet, and the control system is configured to reverse a direction of the circulated air to reduce a concentration of the refrigerant.

15. The refrigerated vending machine of claim 1, further comprising:

a battery configured to provide power to one or more of the first sensor circuit, the second sensor circuit, and the control system when input power is not supplied by an external power source.

* * * * *